US008430343B2

(12) United States Patent
Nagatomo

(10) Patent No.: US 8,430,343 B2
(45) Date of Patent: Apr. 30, 2013

(54) FUEL INJECTION VALVE

(75) Inventor: Hiroaki Nagatomo, Kariya (JP)

(73) Assignee: Denso Corporation, Kariya (JP)

( * ) Notice: Subject to any disclaimer, the term of this patent is extended or adjusted under 35 U.S.C. 154(b) by 133 days.

(21) Appl. No.: 13/028,369

(22) Filed: Feb. 16, 2011

(65) Prior Publication Data

US 2011/0198419 A1 Aug. 18, 2011

(30) Foreign Application Priority Data

Feb. 17, 2010 (JP) ..... 2010-032858
Dec. 17, 2010 (JP) ..... 2010-282001

(51) Int. Cl.
*B05B 1/30* (2006.01)

(52) U.S. Cl.
USPC ..... 239/585.3; 239/585.5; 239/585.1; 123/472; 251/129.16

(58) Field of Classification Search ..... 239/585.1, 239/585.3, 585.5; 251/129.15, 129.16; 123/472
See application file for complete search history.

(56) References Cited

U.S. PATENT DOCUMENTS 6,170,767 B1 * 1/2001 Herold et al. ..... 239/585.3
6,575,388 B2 * 6/2003 Aota et al. ..... 239/533.12
7,252,245 B2 8/2007 Nishiwaki
2008/0277505 A1 11/2008 Hoang
2009/0288640 A1 11/2009 Shingu et al.
2009/0289131 A1 11/2009 Shingu et al.

FOREIGN PATENT DOCUMENTS

JP P2006-097659 A 4/2006

OTHER PUBLICATIONS

Japanese Office Action dated Jan. 31, 2012, issued in corresponding Japanese Application No. 2010-282001 with English Translation.

Chinese Office Action (7 pages) dated Nov. 20, 2012, issued in corresponding Chinese Application No. 2011 1004 1128.9, with at least partial English translation (6 pages).

* cited by examiner

*Primary Examiner* — Dinh Q Nguyen

(74) *Attorney, Agent, or Firm* — Nixon & Vanderhye P.C.

(57) ABSTRACT

A fuel injection valve includes a needle valve having an engagement part, and a movable core having an engagement part to be engaged with the engagement part of the needle valve. One of the engagement part of the needle valve and the engagement part of the movable core is defined by two inner faces of a recess opposing to each other in an axis direction, and the other engagement part is defined by two outer faces of a projection opposing to the inner faces, respectively. The projection is movable between the inner faces in the axis direction in a state that the projection is located in the recess.

16 Claims, 12 Drawing Sheets

FUEL INJECTION VALVE

CROSS REFERENCE TO RELATED APPLICATION

This application is based on Japanese Patent Application No. 2010-32858 filed on Feb. 17, 2010 and Japanese Patent Application No. 2010-282001 filed on Dec. 17, 2010, the disclosures of which are incorporated herein by reference in their entirety.

BACKGROUND OF THE INVENTION

1. Field of the Invention

The present invention relates to a fuel injection valve.

2. Description of Related Art

JP-B2-4243610 discloses a fuel injection valve.

The fuel injection valve has a needle valve to reciprocate in a body, a movable core, an electromagnetic actuator to attract the movable core, and a biasing portion to bias the movable core and the needle valve. The needle valve has a bar shape, and opens/closes an injection hole. The movable core has a cylinder shape, and an inner face of the movable core supports an outer face of the needle valve in a manner that the movable core is movable relative to the needle valve.

Fuel injection from the injection hole is prohibited if the needle valve is seated on a seat portion in a seating direction. Fuel injection from the injection hole is allowed if the needle valve is separated from the seat portion in a separating direction.

The movable core has a column-shaped main part and a based cylinder-shaped sleeve having the same axis as the main part. Each of the main part and the sleeve has a through hole to which a shaft of the needle valve is inserted at a center position in a radial direction. The shaft of the needle valve has two flanges protruding outward in the radial direction from outer circumference face. The two flanges are arranged in an axis direction in distanced state. One of the flanges is a first flange located opposite from the sleeve. When the first flange contacts the main part, the movable core is restricted from moving in the separating direction relative to the needle valve. The other flange is a second flange located on an inner circumference side of the sleeve, and is located between an end face of the main part adjacent to the sleeve and an inner bottom face of the sleeve.

The biasing portion has a first elastic member and a second elastic member. The first elastic member contacts the first flange, and biases the needle valve in the seating direction. The second elastic member is located between the second flange and the inner bottom face of the sleeve. The second elastic member biases the movable core in the seating direction in a state that the needle valve is seated on the seat portion. The body of the fuel injection valve has a stopper to stop a movement of the movable core in the seating direction. When electricity is not supplied to the electromagnetic actuator, magnetic attraction force is not generated, and the movable core is pressed to the stopper by the second elastic member. The movable core is held to be distanced from the first flange.

The electromagnetic actuator is located adjacent to the movable core opposite from the stopper. When the movable core is contact with the stopper, a distance between the movable core and the electromagnetic actuator is larger than a distance between the movable core and the first flange.

Therefore, the movable core can move solely until the movable core contacts the first flange, when magnetic attraction force is generated. If the movable core contacts the first flange, the movable core cannot move in the separating direction relative to the needle valve, so that the needle valve moves in the separating direction together with the movable core. Thereby, the needle valve is separated from the seat portion so as to connect a fuel passage to the injection hole, and fuel supplied from the fuel passage is injected from the injection hole.

In a conventional fuel injection valve to be driven by electromagnetic force, relative movement is prohibited between a movable core and a needle valve. In this case, when magnetic attraction force generated by an actuator is applied to the movable core, the movable core is attracted to the actuator, and the needle valve is moved in the separating direction. When the needle valve is moved in the separating direction, the magnetic attraction force is applied to the needle valve through the movable core.

In contrast, relative movement is allowed between the movable core and the needle valve in the fuel injection valve of JP-B2-4243610. Therefore, when the movable core is engaged with the needle valve and when the needle valve is separated from the seat portion, not only the magnetic attraction force but also a momentum force of the movable core are applied to the needle valve. Thus, moving speed of the needle valve in the separating direction becomes higher compared with the conventional fuel injection valve.

If fuel is supplied to the injection hole from the fuel passage through a clearance generated between the seat portion and the needle valve opposing to the seat portion, the clearance is so small immediately after the needle valve begins separating from the seat portion. At this time, a pressure of fuel flowing into the injection hole is very low. As the clearance becomes larger, the pressure of fuel flowing into the injection hole gradually becomes higher. When the clearance is so small, that is immediately after the needle valve begins separating from the seat portion, sufficient fuel cannot be supplied to the injection hole. If sufficient fuel is not supplied to the injection hole, the pressure of fuel flowing into the injection hole is low. At this time, a speed of fuel injected from the injection hole is slow, and a particle diameter of fuel injected from the injection hole becomes large, compared with a case where the needle valve is located at the farthest position from the seat portion. The particle diameter of fuel is large for a long time if the moving speed of the needle valve is slow in the separating direction.

Compared with the conventional fuel injection valve, the moving speed of the needle valve in the separating direction is made higher in JP-B2-4243610, so that a ratio of fuel having relatively larger particle diameter can be made lower.

A predetermined distance is continuously required between the movable core and the first flange when the needle valve is seated on the seat portion, so as to raise the moving speed of the needle valve in the separating direction. The predetermined distance is maintained by the second elastic member located between the second flange and the sleeve, because the second elastic member presses the movable core onto the stopper, in JP-B2-4243610. If the needle valve and the movable core are configured not to have relative movement with each other, the second elastic member to press the movable core onto the stopper is unnecessary, because the first elastic member presses the needle valve in the seating direction. In contrast, in JP-B2-4243610, the second elastic member to press the movable core onto the stopper is necessary other than the first elastic member to press the needle valve in the seating direction, so as to raise the moving speed of the needle valve in the separating direction. However, the fuel injection valve has a complicated structure in this case.

SUMMARY OF THE INVENTION

In view of the foregoing and other problems, it is an object of the present invention to provide a fuel injection valve.

According to an example of the present invention, a fuel injection valve includes a body, a needle valve, a movable core, an electromagnetic driving portion, and a biasing portion. The body has an injection hole to inject fuel and a seat portion located upstream of the injection hole in a fuel flowing direction. The needle valve linearly reciprocates in an axis direction of the body. Fuel injection from the injection hole is prohibited when the needle valve is seated on the seat portion in a seating direction and is allowed when the needle valve is separated from the seat portion in a separating direction. The cylindrical movable core is moved relative to the needle valve. The needle valve is moved in the seating direction when the movable core is moved in the seating direction, and is moved in the separating direction when the movable core is moved in the separating direction. The electromagnetic driving portion generates magnetic attraction force to attract the movable core in the separating direction by being supplied with electricity. The biasing portion contacts and biases the movable core in the seating direction. The needle valve has a first engagement part and a second engagement part. The movable core has a first engagement part to be engaged with the first engagement part of the needle valve, and a second engagement part to be engaged with the second engagement part of the needle valve. One of a set of the first engagement part and the second engagement part of the needle valve and a set of the first engagement part and the second engagement part of the movable core is defined by two inner faces of a recess opposing to each other in the axis direction, and the other set is defined by two outer faces of a projection opposing to the inner faces, respectively. The projection is movable between the inner faces in the axis direction in a state that the projection is located in the recess. The movable core is restricted from being moved in the seating direction relative to the needle valve when the first engagement part of the needle valve and the first engagement part of the movable core are engaged with each other. The movable core is restricted from being moved in the separating direction relative to the needle valve when the second engagement part of the needle valve and the second engagement part of the movable core are engaged with each other.

Accordingly, fuel injection can be accurately performed with the simple structure.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF PREFERRED EMBODIMENT

Figure 1:
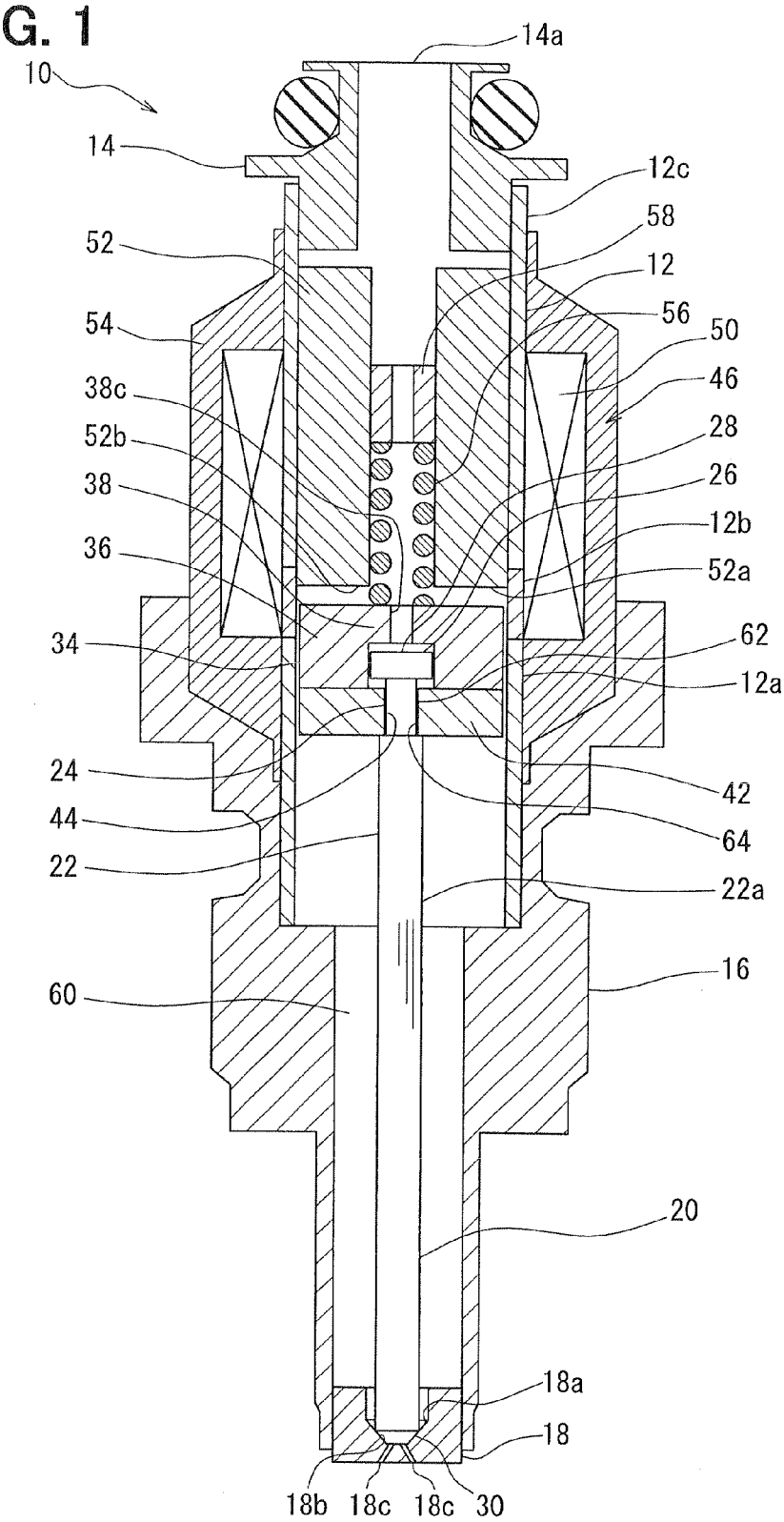
FIG. 1 is a cross-sectional view illustrating a fuel injection valve according to a first embodiment.

It should be understood that throughout the drawings, corresponding reference numerals indicate like or corresponding parts and features.

First Embodiment

A first embodiment will be described with reference to FIGS. 1 and 2.

A fuel injection valve 10 of FIG. 1 is mounted in a direct injection type gasoline engine, for example, and directly injects fuel into a combustion chamber of the engine. The fuel injection valve 10 is attached to a cylinder head of the engine, for example.

The fuel injection valve 10 has a pipe member 12, an inlet member 14, a holder 16, a nozzle body 18, a needle valve 20, a movable core 34, an electromagnetic actuator 46 and a coil spring 56.

An inner diameter of the pipe member 12 is approximately constant in an axis direction. The pipe member 12 has a first magnetic part 12*a*, a nonmagnetic part 12*b* and a second magnetic part 12*c*, which are connected with each other so as to have the same axis. The nonmagnetic part 12*b* prevents a formation of magnetic short circuit between the first magnetic part 12*a* and the second magnetic part 12*c*. The first magnetic part 12*a*, the nonmagnetic part 12*b*, and the second magnetic part 12*c* are connected, for example, by laser welding. The pipe member 12 may be made of single magnetic pipe member, and the nonmagnetic part 12*b* may be produced by heating the single magnetic pipe member.

The inlet member 14 is arranged on a first end of the pipe member 12 in the axis direction. The inlet member 14 is fitted into the pipe member 12. The inlet member 14 has a fuel inlet 14*a* to be connected to a fuel rail (not shown) to which fuel is supplied from a fuel feed pump (not shown). Fuel supplied to the fuel inlet 14*a* from the fuel rail flows into the pipe member 12.

The holder 16 has a cylindrical shape, and is arranged on a second end of the pipe member 12 in the axis direction. The nozzle body 18 is arranged inside of the holder 16. The nozzle body 18 is located on an end of the holder 16 opposite from the pipe member 12. The nozzle body 18 has a based cylinder shape, and is fixed to the holder 16 by fitting or welding. The nozzle body 18 has a conical inner wall 18*a*, and an inner diameter of the wall 18*a* is made smaller as extending opposite from the pipe member 12. A seat portion 18*b* is defined on the inner wall 18*a*. The nozzle body 18 has plural injection holes 18*c* which passes through the nozzle body 18, and the injection hole 18*c* is located adjacent to the seat portion 18*b* opposite from the pipe member 12. The holder 16 and the nozzle body 18 may be integrated with each other.

A fuel passage 60 is defined in the pipe member 12, the holder 16, and the nozzle body 18. A first end of the fuel passage 60 communicates with the fuel inlet 14*a* in the axis direction, and a second end of the fuel passage 60 communicates with the injection hole 18*c* in the axis direction. Fuel drawn through the fuel inlet 14*a* is supplied to the injection hole 18*c* through the passage 60.

The needle valve 20 has a bar shape, and is accommodated in the fuel passage 60 in a manner that the needle valve 20 is linearly reciprocated in the axis direction. The needle valve 20 has a shaft 22 and a contact part 30. The contact part 30 is to be seated on the seat portion 18*b*, and is located on an end of the shaft 22 adjacent to the seat portion 18*b*. The contact part 30 has a conical shape, and a diameter of the contact part 30 is made smaller as extending toward the seat portion 18*b*.

If the needle valve 20 is moved away from the seat portion 18*b*, the contact part 30 is separated from the seat portion 18*b*. At this time, a circular clearance is generated between the contact part 30 and the seat portion 18*b* in accordance with a movement dimension of the needle valve 20. Fuel is supplied from the fuel passage 60 to the injection hole 18*c* through the circular clearance. Thereby, fuel injection from the injection hole 18*c* is allowed, and fuel is injected from the injection hole 18*c*.

If the needle valve 20 is moved toward the seat portion 18*b*, and if the contact part 30 is seated on the seat portion 18*b*, the circular clearance will be eliminated. Thereby, fuel supply to the injection hole 18*c* is stopped. As a result, the fuel injection from the injection hole 18*c* is prohibited so as to stop the fuel injection. The contact part 30 of the needle valve 20 is moved toward the seat portion 18*b* in a seating direction, and is separated from the seat portion 18*b* in a separating direction.

The shaft 22 has a stopper portion 62 to be engaged with a stopper portion 64 of the movable core 34 when the movable core 34 is moved in the axis direction of the needle valve 20. For example, the stopper portion 62 is defined by a recess 24 recessed from a side face 22*a* of the shaft 22 in a radial direction toward the axis of the needle valve 20. The recess 24 is located at a position between the contact part 30 and an end face 26 of the shaft 22 opposite from the contact part 30, and extends over the entire side face 22*a* in a circumference direction.

Figure 2:
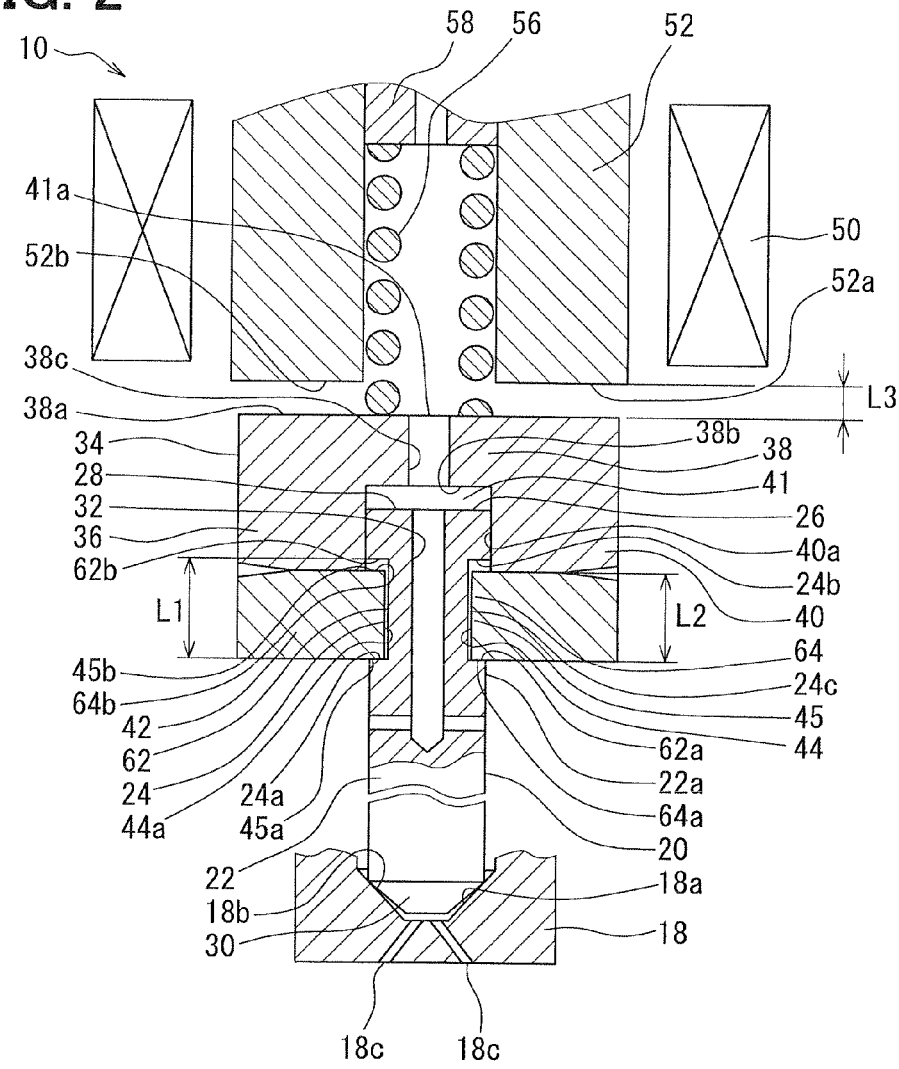
FIG. 2 is a schematic enlarged cross-sectional view of FIG. 1.

As shown in FIG. 2, the stopper portion 62 of the needle valve 20 has a first engagement part 62*a* and a second engagement part 62*b*. The first engagement part 62*a* is constructed by an inner face 24*a* of the recess 24 adjacent to the seat portion 18*b*. The second engagement part 62*b* is constructed by an inner face 24*b* of the recess 24 opposite from the seat portion 18*b*. The inner face 24*a* and the inner face 24*b* oppose to each other in the axis direction of the needle valve 20. The inner face 24*a* and the inner face 24*b* are approximately perpendicular to the axis direction of the needle valve 20. The first engagement part 62*a* and the second engagement part 62*b* are arranged along the axis direction of the needle valve 20.

As shown in FIG. 1, the shaft 22 has a pressure receiving face 28 on the end face 26, and pressure of fuel in the fuel passage 60 is applied to the face 28. The face 28 has shape and area in a manner that the needle valve 20 is thrust in the seating direction by a difference between fuel pressure applied to the face 28 and fuel pressure applied to the contact part 30 when the contact part 30 is seated on or separated from the seat portion 18*b*.

The contact part 30 opposes to the seat portion 18*b*, and the pressure receiving face 28 opposes to the separating direction. Fuel pressure is applied to the face 28 from the fuel passage 60 when the contact part 30 is seated on the seat portion 18*b*. However, fuel pressure is not applied to the seat portion 18*b* and the injection hole 18*c* in this state. That is, at this time, a section between the seat portion 18*b* and the injection hole 18*c* receives atmospheric pressure, for example, which is very lower than the fuel pressure in the fuel passage 60. Because the fuel pressure applied to the face 28 is larger than the pressure applied to the section, a force is generated to thrust the needle valve 20 in the seating direction.

When the contact part 30 is separated from the seat portion 18*b*, fuel pressure is applied to the face 28 from the fuel passage 60. At this time, the contact part 30 contacts fuel in the fuel passage 60 through a clearance generated between the contact part 30 and the seat portion 18*b*. The clearance is smaller than a sectional area of the fuel passage 60 upstream of the clearance. Therefore, a rate of fuel flowing into the injection hole 18*c* is small, and fuel pressure applied to the contact part 30 is lower than the fuel pressure in the fuel passage 60. Thus, the thrust force is generated to the needle valve 20 in the seating direction even if the contact part 30 is separated from the seat portion 18*b* because the fuel pressure applied to the face 28 is larger than the fuel pressure applied to the contact part 30.

As shown in FIG. 2, the shaft 22 has a communication path 32 to communicate with the fuel passage 60, and fuel flows through communication path 32. The communication path 32 has a vertical hole extending in the axis direction from the end face 26, and a lateral hole which connects the vertical hole to the side face 22*a* of the shaft 22. The vertical hole extends by the recess 24 toward the contact part 30, and opens in the end face 26. However, the vertical hole does not reach the contact part 30. The lateral hole is located between the contact part 30 and the recess 24.

The movable core 34 causes the needle valve 20 to move in the seating direction or the separating direction. The movable core 34 has a cylindrical shape, and is made of magnetic material such as iron. The movable core 34 is accommodated in the fuel passage 60, and is linearly reciprocated in the axis direction. The movable core 34 is able to reciprocate in the axis direction of the needle valve 20 relative to the needle valve 20. The movable core 34 has the same axis as the needle valve 20 in a manner that the end face 26 and the recess 24 are located in the movable core 34 and that the movable core 34 overlaps with the needle valve 20 in the axis direction.

The movable core 34 has a based cylindrical main part 36 and a disk part 42. An opening of the main part 36 opposes to the contact part 30, and the end face 26 of the needle valve 20 is located in the main part 36. The main part 36 has a bottom 38 and a cylinder 40 extending from the bottom 38 toward the contact part 30. An inner wall face 40*a* of the cylinder 40 supports the side face 22*a* of the needle valve 20 in the radial direction, and the supported side face 22*a* is in a range between the end face 26 and the second engagement part 62*b*, in a manner that the main part 36 and the needle valve 20 have a relative movement at least in the axis direction.

The bottom 38 has a passage 38*c* to connect an outer wall face 38*a* to an inner wall face 38*b*. An inner space 41 is defined inside of the movable core 34 by the inner wall face 38*b* of the bottom 38, the inner face wall 40*a* of the cylinder 40, the end face 26 of the needle valve 20 and the communication path 38*c*. The pressure receiving face 28 is located in the inner space 41.

Because fuel flows into the inner space 41 from the fuel passage 60 outside of the movable core 34, fuel pressure is applied to the face 28 from the fuel passage 60. Therefore, even if the face 28 is covered by the movable core 34, the fuel pressure can be securely applied to the face 28 from the fuel passage 60.

The disk part 42 is arranged at a position to close the opening of the main part 36. The disk part 42 and the main part 36 are joined with each other by welding, for example. The disk part 42 has a stopper portion 64 which stops a movement of the movable core 34 relative to the needle valve 20 in the seating direction or the separating direction. When the movable core 34 is moved in the axis direction, the stopper portion 64 is engaged with the stopper portion 62 of the needle valve 20. For example, the stopper portion 64 of the movable core 34 is defined by a notch 44 shown in FIG. 3.

Figure 3:
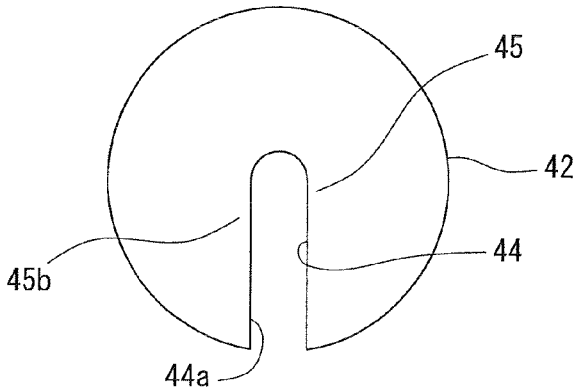
FIG. 3 is a plan view illustrating a disc part of a movable core of the fuel injection valve.

As shown in FIG. 3, the notch 44 extends from a periphery of the disk part 42 to a center position in the radial direction, and, as shown in FIG. 2, the notch 44 extends through the disk part 42 in the axis direction. An outer periphery end of the notch 44 is open to outside, and a center end of the notch 44 is surrounded by the disc part 42. An inner wall face 44*a* of the notch 44 opposes to a bottom face 24*c* of the recess 24 in the radial direction in a manner that the disc part 42 and the needle valve 20 have a relative movement at least in the axis direction. The notch 44 of the disc part 42 defines a projection 45 opposing to the recess 24, and the projection 45 is projected into the recess 24. The projection 45 is movable between the inner faces 24*a*, 24*b* in the axis direction in this state. The projection 45 has an end face 45*a* opposing to the inner face 24*a*, and an end face 45*b* opposing to the inner face 24*b*. The end face 45*a* is located adjacent to the seat portion 18*b*, and the end face 45*b* is located opposite from the seat portion 18*b*.

The stopper portion 64 of the movable core 34 has a first engagement part 64*a* and a second engagement part 64*b*. The first engagement part 64*a* is defined by the end face 45*a*, and the second engagement part 64*b* is defined by the end face 45*b*. The first engagement part 64*a* of the movable core 34 opposes to the first engagement part 62*a* of the needle valve 20. The second engagement part 64*b* of the movable core 34 opposes to the second engagement part 62*b* of the needle valve 20.

A distance L1 defined between the first engagement part 62*a* and the second engagement part 62*b* is larger than a distance L2 defined between the first engagement part 64*a* and the second engagement part 64*b*. The inner face wall 38*b* of the bottom 38 of the main part 36 is distant from the end face 26 of the needle valve 20 when the first engagement part 62*a* of the needle valve 20 and the first engagement part 64*a* of the movable core 34 are engaged with each other.

The needle valve 20 has the stopper portion 62, and the movable core 34 has the stopper portion 64. The first engagement part 62*a*, 64*a* and the second engagement part 62*b*, 64*b* of the stopper portion 62, 64 have the above-described position relationship. Therefore, the movable core 34 can be moved relative to the needle valve 20 in the axis direction by a distance L1-L2, which is calculated by subtracting the distance L2 from the distance L1.

If the engagement parts 62*a*, 64*a* are engaged with each other while the movable core 34 is moved in the seating direction, the movable core 34 is restricted from moving in the seating direction relative to the needle valve 20. If the engagement parts 62*b*, 64*b* are engaged with each other while the movable core 34 is moved in the separating direction, the movable core 34 is restricted from moving in the separating direction relative to the needle valve 20.

The fuel injection valve 10 has the electromagnetic actuator 46. The electromagnetic actuator 46 is a drive unit which generates magnetic attraction force and draws the movable core 34 by being supplied with electricity. As shown in FIG. 1, the electromagnetic actuator 46 has a coil 50, a fixed core 52, and a housing 54.

The coil 50 is arranged on an outer periphery side of the pipe member 12. The coil 50 has a tube-shaped spool made of resin, and a wire member wound around the spool. The wire member is connected to a terminal of a connector (not shown). The fixed core 52 is disposed on an inner circumference side of the coil 50 through the pipe member 12. The fixed core 52 is located in the fuel passage 60. The fixed core 52 has a tube shape, and is made of magnetic material such as iron. The core 52 is fixed to an inner circumference side of the pipe member 12 by press-fitting, for example.

The fixed core 52 is located adjacent to the movable core 34 opposite from the seat portion 18*c*. The fixed core 52 has an end face 52*a* opposing to the movable core 34, and the end face 52*a* has an attracting part 52*b* which generates magnetic attraction force. The attracting part 52*b* contacts the outer wall face 38*a* of the bottom 38 of the main part 36 which opposes to the attracting part 52*b*.

The core 52 is fixed at a position in a manner that a distance between the second engagement parts 62*b*, 64*b* becomes narrower than a distance L3 defined between the outer wall face 38*a* and the attracting part 52*b*, when the first engagement part 62*a* of the needle valve 20 and the first engagement part 64*a* of the movable core 34 are engaged with each other, and when the contact part 30 of the needle valve 20 is seated on the seat portion 18*b*. For example, the distance L3 is longer than the distance L1-L2, which is calculated by subtracting the distance L2 from the distance L1.

The housing 54 has a tube shape, and is made of magnetic material such as iron. The housing 54 covers the coil 50. As shown in FIG. 1, an end of the housing 54 in the axis direction adjacent to the holder 16 is contact with the first magnetic part 12*a* of the pipe member 12. The housing 54 and the first magnetic part 12*a* are fixed by welding, for example. The other end of the housing 54 opposite from the holder 16 is contact with the second magnetic part 12*c* of the pipe member 12.

The coil spring 56 is located on an inner circumference side of the fixed core 52. One end of the coil spring 56 is contact with the movable core 34, and the other end is contact with an adjusting pipe 58. The pipe 58 is fixed to the inner circumference face of the fixed core 52 by press-fitting, for example.

The coil spring 56 is arranged between the movable core 34 and the adjusting pipe 58 in the axis direction in compressed state. Therefore, the coil spring 56 gives an elastic force to the movable core 34 in accordance with the compression amount. A direction of the elastic force corresponds to the seating direction, and is opposite to a direction of the magnetic attraction force. The elastic force is adjusted by adjusting a press-fitting amount of the adjusting pipe 58 relative to the fixed core 52.

As shown in FIG. 2, an outer diameter of the coil spring 56 is larger than an inner diameter of an opening 41*a* of the communication path 38*c* located on the end of the movable core 34. Therefore, the coil spring 56 is prevented from being inserted into the inner space 41. Thus, the elastic force of the coil spring 56 is given only to the movable core 34, but is not given to the needle valve 20.

The inner face 24*a* and the inner face 24*b* of the recess 24 of the needle valve 20 may correspond to inner faces of a recess. The end face 45*a* and the end face 45*b* of the projection 45 of the movable core 34 may correspond to outer faces of a projection.

Operations of the fuel injection valve 10 will be explained with reference to FIGS. 4A-5C.

Figure 4A:
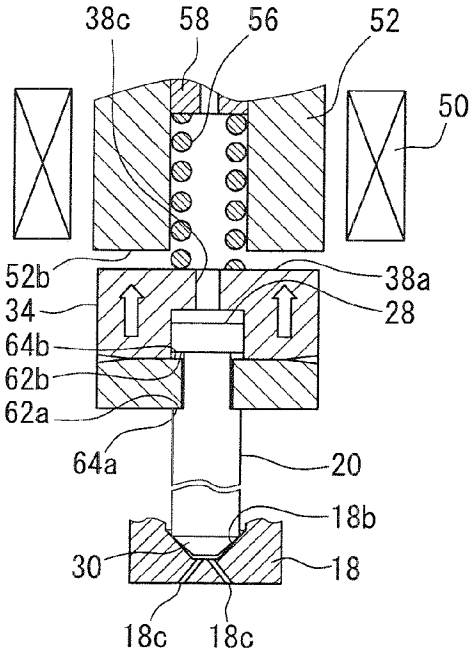
FIGS. 4A, 4B and 4C are views illustrating a movement of the movable core and a movement of a needle valve of the fuel injection valve when fuel injection is started.

As shown in FIG. 4A, when electricity is not supplied to the coil 50, magnetic attraction force is not generated in the attracting part 52*b* of the fixed core 52. Therefore, the movable core 34 is moved in the seating direction by the elastic force of the coil spring 56, so that the first engagement part 64*a* of the movable core 34 and the first engagement part 62*a* of the needle valve 20 are engaged with each other. At this time, as shown in FIG. 4A, the second engagement part 64*b* of the movable core 34 is separated from the second engagement part 62*b* of the needle valve 20 only by the distance L1-L2. Because the first engagement part 62*a* and the first engagement part 64*a* are engaged with each other, the elastic force applied to the movable core 34 in the seating direction is transmitted to the needle valve 20 through the first engagement part 62*a* and the first engagement part 64*a*. Thus, the contact part 30 is seated on the seat portion 18*b*. Because fuel supply from the fuel passage 60 to the injection hole 18*c* is stopped, fuel is not injected from the injection hole 18*c*. Further, because the coil spring 56 presses the movable core 34 in the seating direction, the needle valve 20 continues seated.

Figure 4B:
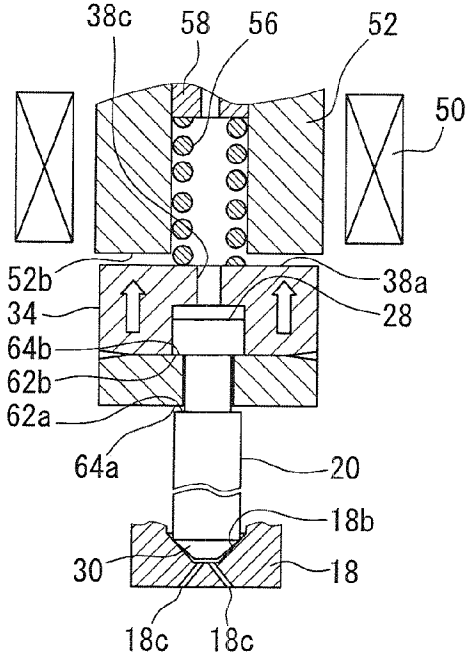

If electricity is supplied to the coil 50, a magnetic field is generated in the coil 50, so that flux of magnetic induction flows into the housing 54, the first magnetic part 12*a*, the movable core 34, the fixed core 52, and the second magnetic part 12*c*. Thus, a magnetic circuit can be formed. Thereby, magnetic attraction force occurs in the attracting part 52*b* of the fixed core 52. If the magnetic attraction force becomes larger than the elastic force of the coil spring 56, the movable core 34 starts to move in the separating direction based on a force calculated by subtracting the elastic force from magnetic attraction force. When the first engagement part 64*a* and the first engagement part 62*a* are engaged with each other, the second engagement part 64*b* of the movable core 34 is distant from the second engagement part 62*b* of the needle valve 20 only by the distance L1-L2. Therefore, only the movable core 34 can be moved toward the attracting part 52*b* in the separating direction until the second engagement part 64*b* and the second engagement part 62*b* are engaged with each other, as shown in FIG. 4B. Before the second engagement part 64*b* and the second engagement part 62*b* are engaged with each other, the needle valve 20 continues seated due to the thrust force generated by the difference between the pressure applied to the receiving face 28 and the pressure applied to the contact part 30.

Figure 4C:
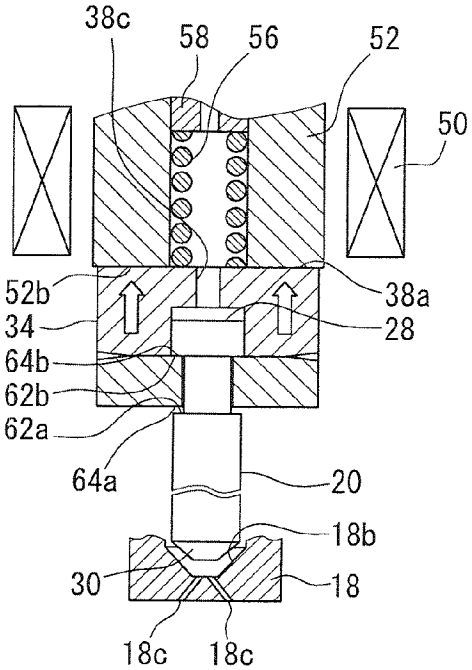

As shown in FIG. 4B, when the movable core 34 is moved in the separating direction, the second engagement part 64*b* of the movable core 34 is engaged with the second engagement part 62*b* of the needle valve 20. When the second engagement part 62*b* and the second engagement part 64*b* are engaged with each other, the movable core 34 is restricted from moving in the separating direction relative to the needle valve 20. At this time, the outer wall face 38*a* of the movable core 34 and the attracting part 52*b* of the fixed core 52 are separated from each other by a distance L3-(L1-L2). Therefore, the needle valve 20 is moved toward the attracting part 52*b* in the separating direction together with the movable core 34 as shown in FIG. 4C, if the magnetic attraction force is generated at the attracting part 52*b* by the electricity supplied to the coil 50.

When the second engagement part 64*b* of the movable core 34 is engaged with the second engagement part 62*b* of the needle valve 20, a force subtracting the elastic force from a momentum force of the movable core 34 and the magnetic attraction force applied to the movable core 34 is transmitted to the needle valve 20 through the engagement parts 62*b*, 64*b*. The needle valve 20 is moved in the separating direction in accordance with a force subtracting the force to thrust the needle valve 20 in the seating direction from the force transmitted from the movable core 34. Thereby, the contact part 30 is separated from the seat portion 18*b*.

If the contact part 30 is separated from the seat portion 18*b*, a clearance is generated between the contact part 30 and the seat portion 18*b*. Fuel is supplied to the injection hole 18*c* from the fuel passage 60 through the clearance, and fuel is injected from the injection hole 18*c*.

A conventional fuel injection valve to be driven by electromagnetic force integrally has a movable core and a needle valve, which are configured not to have a relative movement with each other. The needle valve is moved in the separating direction with a speed corresponding to a force calculated by subtracting a pressing force to press the needle valve in the seating direction from a magnetic attraction force, because the movable core and the needle valve are integrated with each other.

In contrast, according to the first embodiment, the movable core 34 and the needle valve 20 can have relative movement in the axis direction. Further, the needle valve 20 has the stopper portion 62, and the movable core 34 has the stopper portion 64. Furthermore, the stopper portions 62, 64 and the electromagnetic actuator 46 have the above-mentioned position relationship. Therefore, not only the force calculated by subtracting the elastic force of the coil spring 56 from the magnetic attraction force but also the momentum force of the movable core 34 are transmitted to the needle valve 20 through the second engagement parts 62*b*, 64*b*. Thus, the moving speed of the needle valve 20 in the separating direction can be made higher than that of the conventional fuel injection valve.

Fuel injection will be described immediately after the needle valve 20 begins to separate from the seat portion 18*b*. Immediately after the contact part 30 is separated from the seat portion 18*b*, the clearance between the contact part 30 and the seat portion 18*b* which communicates the fuel passage 60 and the injection, hole 18*c* is so small, so that sufficient fuel cannot be supplied to the injection hole 18*c*. If enough fuel is not supplied to the injection hole 18*c*, pressure of fuel flowing into the injection hole 18*c* is low. Further, because speed of fuel injected from the injection hole 18*c* is slow, a particle diameter of fuel injected from the injection hole 18*c* is large compared with a case where the contact part 30 is located at the farthest position from the seat portion 18*b*.

According to the first embodiment, the moving speed of the needle valve 20 can be raised in the separating direction. Therefore, the clearance between the contact part 30 and the seat portion 18*b* is quickly made larger, so that enough fuel can be quickly supplied to the injection hole 18*c*. Thus, a ratio of fuel having relatively large particle diameter can be reduced when fuel is injected from the injection hole 18*c*.

However, when the needle valve 20 is separated from the seat portion 18*b*, as shown in FIG. 4B, the engagement parts 62*a*, 64*a* are not engaged with each other. That is, in this state, the needle valve 20 may be moved in a manner that the distance between the engagement parts 62*a*, 64*a* is shortened. For example, when the engagement part 64*b* collides with the engagement part 62*b*, the needle valve 20 may be moved in the seating direction relative to the movable core 34, so that the engagement parts 62*b*, 64*b* may be separated from each other. In this case, the movement of the needle valve 20 does not correspond to the movement of the movable core 34, and fuel supply to the injection hole 18*c* becomes unstable, so that fuel injection may not be accurately performed.

According to the first embodiment, the needle valve 20 has the pressure receiving face 28. The needle valve 20 is thrust in the seating direction by applying the fuel pressure from the fuel passage 60 onto the receiving face 28. Therefore, even if the contact part 30 is distant from the seat portion 18*b*, the engagement between the second engagement part 62*b* of the needle valve 20 and the second engagement part 64*b* of the movable core 34 can be maintained. Thus, fuel injection can be accurately performed, because the separating movement of the needle valve 20 can be made to follow the movement of the movable core 34.

When the second engagement part 62*b* and the second engagement part 64*b* are engaged with each other, and when the movable core 34 is moved by the distance L3−(L1−L2), as shown in FIG. 4C, the outer wall face 38*a* of the movable core 34 will collide with the attracting part 52*b*. If the movable core 34 collides with the attracting part 52*b*, the movable core 34 will rebound in the seating direction. Because relative motion is possible between the movable core 34 and the needle valve 20, the needle valve 20 can continue moving in the separating direction according to inertia force. Thus, because the movable core 34 and the needle valve 20 can be moved in directions opposite from each other, the needle valve 20 becomes less affected by the rebound of the movable core 34 at the fixed core 52. Accordingly, a variation of injection rate can be reduced when the needle valve 20 has the maximum lift.

Figure 5A:
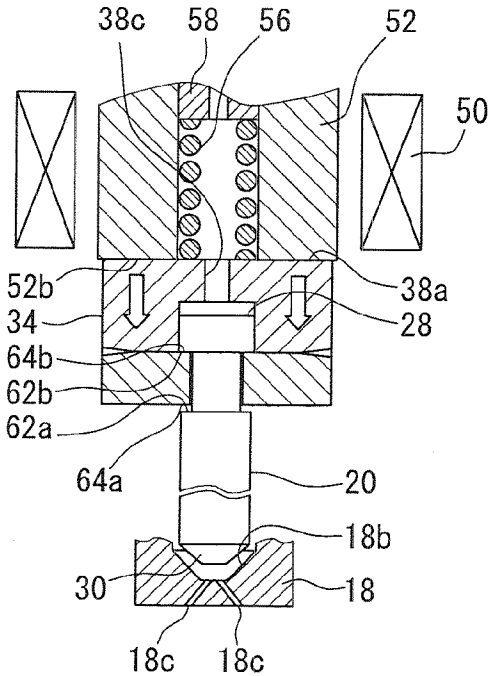
FIGS. 5A, 5B and 5C are views illustrating a movement of the movable core and a movement of the needle valve when fuel injection is stopped.

As shown in FIG. 5A, if electricity supply to the coil 50 is stopped in the state where the movable core 34 is contact with the fixed core 52, the magnetic attraction force generated in the attracting part 52*b* of the fixed core 52 will be extinguished. Thereby, the movable core 34 begins to move in the seating direction by the elastic force of the coil spring 56. When the magnetic attraction force is extinguished, the first engagement part 62*a* of the needle valve 20 and the first engagement part 64*a* of the movable core 34 are separated from each other, so that only the movable core 34 is moved in the seating direction, because the needle valve 20 tries to remain at that occasion according to inertia force. The needle valve 20 may also move in the seating direction together with the movable core 34 due to the thrust force in the seating direction based on the difference between the fuel pressure applied to the face 28 and the fuel pressure applied to the contact part 30. A case where only the movable core 34 is moved will be described in the present embodiment.

Figure 5B:
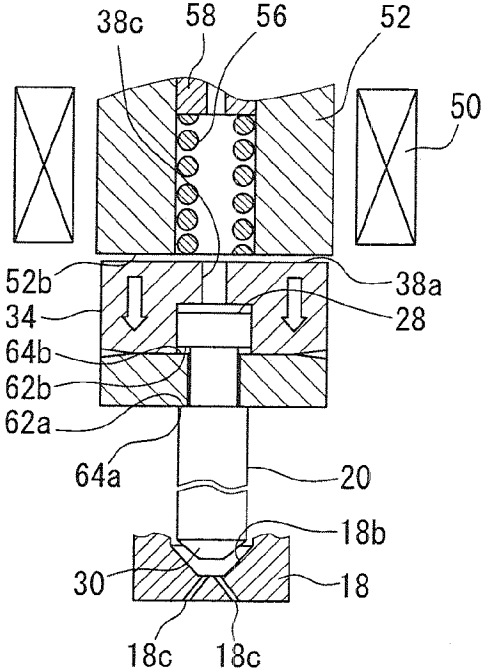

As shown in FIG. 5B, if the movable core 34 begins to move in the seating direction, the engagement between the second engagement part 62*b* of the needle valve 20 and the second engagement part 64*b* of the movable core 34 will be canceled. Then, if the movable core 34 is further moved in the seating direction, the first engagement part 64*a* of the movable core 34 will be engaged with the first engagement part 62*a* of the needle valve 20. At this time, the contact part 30 of the needle valve 20 is separated from the seat portion 18*b*.

Because the first engagement part 62*a* and the first engagement part 64*a* are engaged with each other, the movable core 34 is restricted from moving in the seating direction relative to the needle valve 20. Therefore, the elastic force of the coil spring 56 applied to the movable core 34 is transmitted to the needle valve 20 through the first engagement part 62*a* and the first engagement part 64*a*. Thereby, the needle valve 20 is moved in the seating direction together with the movable core 34.

Figure 5C:
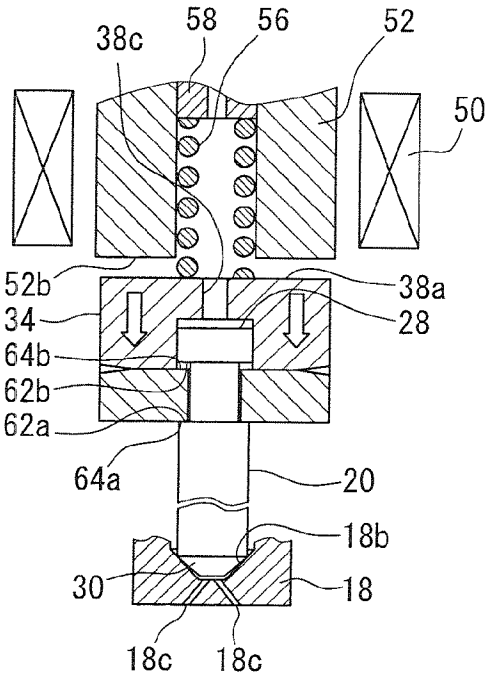

As shown in FIG. 5C, the contact part 30 of the needle valve 20 is seated on the seat portion 18*b* again, and the clearance between the contact part 30 and the seat portion 18*b* is extinguished. Thereby, the fuel injection from the injection hole 18*c* stops because fuel supply from the fuel passage 60 to the injection hole 18*c* stops. The coil spring 56 always presses the movable core 34 in the seating direction. Therefore, the elastic force is transmitted to the needle valve 20 through the first engagement part 62*a* and the first engagement part 64*a* also after the needle valve 20 is seated on the seat portion 18*b*. Thereby, the seating state of the needle valve 20 is maintained. Moreover, simultaneously, due to the coil spring 56, the movable core 34 can be held in the position in a manner that the first engagement part 62*a* and the first engagement part 64*a* are engaged with each other, and that the second engagement part 62*b* and the second engagement part 64*b* are separated from each other.

According to the first embodiment, the needle valve 20 can be maintained to be seated on the seat portion 18*b* only by the single coil spring 56. Further, the movable core 34 can be maintained to be located at a predetermined position in a manner that the engagement parts 62*b*, 64*b* are separated from each other. That is, a stopper or an elastic member to press the movable core 34 onto the stopper is unnecessary for holding the movable core 34 at the predetermined position, compared with the conventional fuel injection valve. Due to the coil spring 56 of the present embodiment, the needle valve 20 is maintained to be seated on the seat portion 18*b*, and the movable core 34 is maintained to be located at the predetermined position. Accordingly, the moving speed of the needle valve 20 can be made higher in the separating direction with the simple structure.

Second Embodiment

A second embodiment will be described with reference to FIG. 6, and corresponds to a modification of the first embodiment. In the second embodiment, a distance L1 defined between a first engagement part 62*a* and a second engagement part 62*b* of a stopper portion 62 of a needle valve 120 of a fuel injection valve 110 is smaller than a distance L2 defined between a first engagement part 64*a* and a second engagement part 64*b* of a stopper portion 64 of a movable core 134 of the fuel injection valve 110.

The engagement part 62*a*, 62*b* of the needle valve 120 is movable between the engagement part 64*a*, 64*b* of the movable core 134 in the axis direction of the needle valve 120. Further, similar to the first embodiment, a distance between the second engagement parts 62*b*, 64*b* is narrower than a distance L3 defined between an outer wall face 138*a* of the movable core 134 and an attracting part 52*b*, when the first engagement part 62*a* of the needle valve 120 and the first engagement part 64*b* of the movable core 134 are engaged with each other, and when a contact part 30 of the needle valve 120 is seated on a seat portion 18*b*.

The needle valve 120 and the movable core 134 are described with reference to FIG. 6.

Similar to the first embodiment, the needle valve 120 has a shaft 122 and the contact part 30. The contact part 30 located adjacent to the seat portion 18*b* has a conical shape, and a diameter of the contact part 30 becomes smaller as extending toward the seat portion 18*b*.

The shaft 122 has the stopper portion 62 defined by an annular projection 124 projected outward from a side face 122*a* of the shaft 122 in a radial direction. The projection 124 is located at an end portion of the shaft 122 opposite from the contact part 30. The projection 124 has an end face 124*a* opposite from the seat portion 18*b*, and an end face 124*b* adjacent to the seat portion 18*b*.

The stopper portion 62 of the needle valve 120 has the first engagement part 62*a* and the second engagement part 62*b*. The first engagement part 62*a* is defined by the end face 124*a* of the projection 124. The second engagement part 62*b* is defined by the end face 124*b* of the projection 124. The end faces 124*a*, 124*b* are approximately perpendicular to the axis direction of the needle valve 120. As shown in FIG. 6, the first engagement part 62*a* and the second engagement part 62*b* are arranged along the axis direction of the needle valve 120.

The shaft 122 has a pressure receiving face 126 on the end face 124*a*, and pressure of fuel in the fuel passage 60 is applied to the face 126. The face 126 has shape and area in a manner that the needle valve 120 is thrust in the seating direction by a difference between fuel pressure applied to the face 126 and fuel pressure applied to the contact part 30 when the contact part 30 is seated on or separated from the seat portion 18*b*.

A principle that the needle valve 120 is thrust in the seating direction is omitted, because the principle is approximately the same as that of the first embodiment.

The movable core 134 has a cylindrical shape, and is linearly reciprocated in the axis direction relative to the needle valve 120. The movable core 134 has the same axis as the needle valve 120 in a manner that the projection 124 of the needle valve 120 is located in the movable core 134 and that the movable core 134 overlaps with the needle valve 120 in the axis direction.

The movable core 134 has a based cylindrical first member 136 and a based cylindrical second member 140. An inner diameter of the first member 136 is approximately the same as an outer diameter of the second member 140. As shown in FIG. 6, the second member 140 is arranged inside of the first member 136 in a manner that an open end of the second member 140 contacts an inner wall face 138*b* of a bottom 138 of the first member 136. The first member 136 and the second member 140 are joined with each other by welding, for example.

The movable core 134 is arranged in the fuel passage 60 in a manner that an outer wall face 138*a* of the bottom 138 of the first member 136 is located opposite from the contact part 30 and that an outer wall face 142*a* of a bottom 142 of the second member 140 opposes to the contact part 30. As shown in FIG. 6, the projection 124 of the needle valve 120 is located in a space defined by an inner wall face 142*b* of the bottom 142 of the second member 140, an inner wall face 146*a* of a cylinder 146 of the second member 140 extending from the bottom 142 in the separating direction, and the inner wall face 138*b* of the bottom 138 of the first member 136. Further, the bottom 142 of the second member 140 has a through hole 144 to connect the outer wall face 142*a* and the inner wall face 142 of the bottom 142, and the shaft 122 passes through the through hole 144.

The inner wall face 146*a* of the cylinder 146 of the second member 140 supports a side face 124*c* of the projection 124 from outside in the radial direction in a manner that the second member 140 and the needle valve 120 can have relative movement with each other at least in the axis direction. Further, an inner wall face 144*a* of the through hole 144 supports a side face 122*a* of the shaft 122 adjacent to the projection 124 from outside in the radial direction in a manner that the second member 140 and the needle valve 120 can have relative movement with each other at least in the axis direction.

The movable core 134 has the stopper portion 64 which stops a movement of the movable core 134 relative to the needle valve 120 in the seating direction or the separating direction, when the movable core 134 is moved in the axis direction of the needle valve 120, and when the stopper portion 64 is engaged with the stopper portion 62 of the needle valve 120. The stopper portion 64 of the movable core 134 has the first engagement part 64*a* and the second engagement part 64*b*.

A recess 150 is defined by the bottom 138 of the first member 136, the bottom 142 of the second member 140, and the cylinder 146 of the second member 140, and is recessed outward from the inner wall face 144*a* of the through hole 144 in the radial direction. As shown in FIG. 6, the projection 124 is located in the recess 150, and is movable in the axis direction. The first engagement part 64*a* is defined by the inner wall face 138*b* of the bottom 138 of the first member 136, and the second engagement part 64*b* is defined by the inner wall face 142*b* of the bottom 142 of the second member 140.

The first engagement part 64*a* of the movable core 134 opposes to the first engagement part 62*a* of the needle valve 120. The second engagement part 64*b* of the movable core 134 opposes to the second engagement part 62*b* of the needle valve 120.

In the second embodiment, which is different from the first embodiment, the distance L1 defined between the first engagement part 62*a* and the second engagement part 62*b* of the stopper portion 62 of the needle valve 120 is smaller than the distance L2 defined between the first engagement part 64*a* and the second engagement part 64*b* of the stopper portion 64 of the movable core 134.

The needle valve 120 has the stopper portion 62, and the movable core 134 has the stopper portion 64. The first engagement part 62*a*, 64*a* and the second engagement part 62*b*, 64*b* of the stopper portion 62, 64 have the above-described position relationship. Therefore, the movable core 134 can be moved relative to the needle valve 120 in the axis direction by a distance L2−L1, which is calculated by subtracting the distance L1 from the distance L2.

A fixed core 52 is fixed at a position in a manner that a distance between the second engagement parts 62*b*, 64*b* becomes narrower than a distance L3 defined between the outer wall face 138*a* and the attracting part 52*b*, when the first engagement part 62*a* of the needle valve 120 and the first engagement part 64*a* of the movable core 134 are engaged with each other, and when the contact part 30 of the needle valve 120 is seated on the seat portion 18*b*. That is, the distance L3 is longer than the distance L2−L1, which is calculated by subtracting the distance L1 from the distance L2.

Therefore, similar to the first embodiment, the movable core 134 and the needle valve 120 are movable in the separating direction in the state that the engagement parts 62*b*, 64*b* are engaged with each other, after the movable core 134 is moved toward the fixed core 52 in the separating direction.

The bottom 138 of the first member 136 of the movable core 134 has a communication path 138*c* to connect the outer wall face 138*a* to the inner wall face 138*b*. An inner space 148 is defined inside of the movable core 134 by the inner wall face 138*b* of the bottom 138 of the first member 136, the inner wall face 146*a* of the cylinder 146 of the second member 140, the end face 124*a* of the needle valve 120 and the communication path 138*c*. The pressure receiving face 126 is located in the inner space 148.

Because fuel flows into the inner space 148 from the fuel passage 60 outside of the movable core 134, fuel pressure is applied to the face 126 from the fuel passage 60. Therefore, although the face 126 is covered by the movable core 134, the fuel pressure can be securely applied to the face 126 from the fuel passage 60.

An outer diameter of the coil spring 56 is larger than an inner diameter of an opening 148*a* of the communication path 138*c* located on an end of the movable core 134. Therefore, the coil spring 56 is prevented from being inserted into the inner space 148. Thus, the elastic force of the coil spring 56 is applied only to the movable core 134, but is not applied to the needle valve 120.

The end faces 124*a*, 124*b* of the projection 124 of the needle valve 120 correspond to outer faces of a projection. The inner wall face 138*b* of the bottom 138 of the first member 136 and the inner wall face 142*b* of the bottom 142 of the second member 140 correspond inner faces of a recess. The inner wall face 138*b* corresponds to an inner face opposite from the seat portion, and the inner wall face 142*b* corresponds to an inner face adjacent to the seat portion.

Operations of the fuel injection valve 110 will be explained with reference to FIGS. 7A-8C.

Figure 7A:
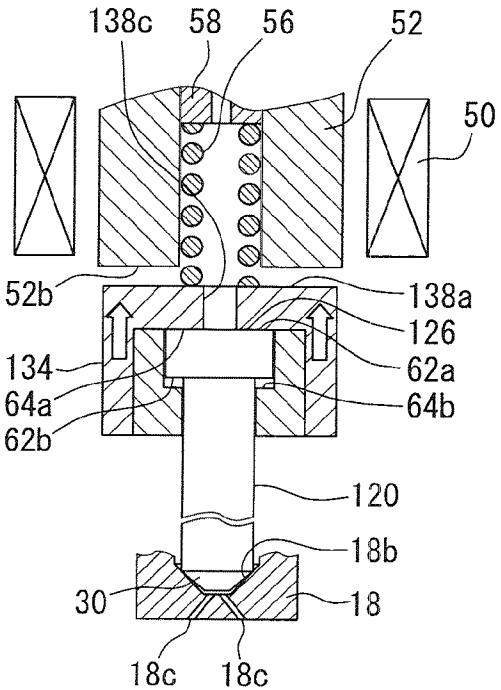
FIGS. 7A, 7B and 7C are views illustrating a movement of a movable core and a movement of a needle valve of the fuel injection valve of the second embodiment when fuel injection is started.

As shown in FIG. 7A, when electricity is not supplied to the coil 50, magnetic attraction force is not generated in the attracting part 52*b* of the fixed core 52. Therefore, the movable core 134 is moved in the seating direction by the elastic force of the coil spring 56, so that the first engagement part 64*a* of the movable core 134 and the first engagement part 62*a* of the needle valve 120 are engaged with each other. At this time, as shown in FIG. 7A, the second engagement part 64*b* of the movable core 134 is separated from the second engagement part 62*b* of the needle valve 120 only by the distance L1−L2. Because the first engagement part 62*a* and the first engagement part 64*a* are engaged with each other, the elastic force applied to the movable core 134 in the seating direction is transmitted to the needle valve 120 through the first engagement part 62*a* and the first engagement part 64*a*. Thus, the contact part 30 is seated on the seat portion 18*b*. Because fuel supply from the fuel passage 60 into the injection hole 18*c* is stopped, fuel is not injected from the injection hole 18*c*. Further, because the coil spring 56 presses the movable core 134 in the seating direction, the needle valve 120 continues seated.

Figure 7B:
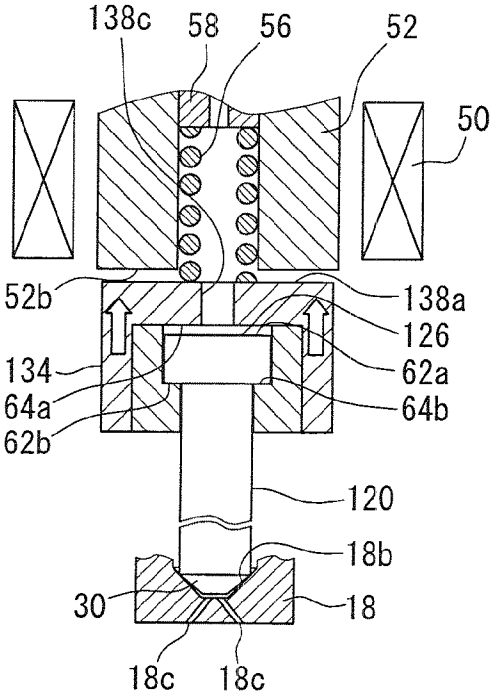

If electricity is supplied to the coil 50, a magnetic field is generated in the coil 50, so that flux of magnetic induction flows into the housing 54, the first magnetic part 12*a*, the movable core 134, the fixed core 52, and the second magnetic part 12*c*. Thus, a magnetic circuit can be formed. Thereby, magnetic attraction force occurs in the attracting part 52*b* of the fixed core 52. If the magnetic attraction force becomes larger than the elastic force of the coil spring 56, the movable core 134 starts to move in the separating direction based on a force calculated by subtracting the elastic force from the magnetic attraction force. When the first engagement part 64*a* and the first engagement part 62*a* are engaged with each other, the second engagement part 64*b* of the movable core 134 is distant from the second engagement part 62*b* of the needle valve 120 only by the distance L1−L2. Therefore, only the movable core 134 can be moved toward the attracting part 52*b* in the separating direction until the second engagement part 64*b* and the second engagement part 62*b* are engaged with each other, as shown in FIG. 7B. Before the second engagement part 64*b* and the second engagement part 62*b* are engaged with each other, the needle valve 120 continues seated due to the thrust force generated by the difference between the pressure applied to the receiving face 126 and the pressure applied to the contact part 30.

Figure 7C:
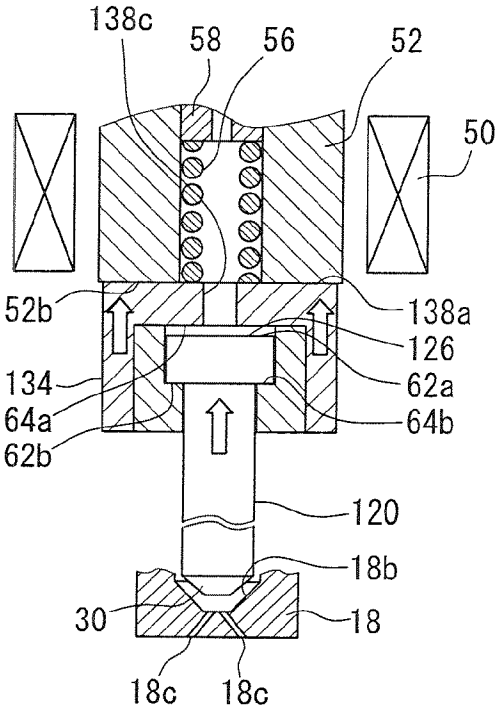

As shown in FIG. 7B, if the movable core 134 is moved in the separating direction, the second engagement part 64*b* of the movable core 134 is engaged with the second engagement part 62*b* of the needle valve 120. When the second engagement part 62*b* and the second engagement part 64*b* are engaged with each other, the movable core 134 is restricted from moving in the separating direction relative to the needle valve 120. At this time, the outer wall face 138*a* of the movable core 134 and the attracting part 52*b* of the fixed core 52 are separated from each other by a distance L3−(L2−L1). Therefore, the needle valve 120 is moved toward the attracting part 52*b* in the separating direction together with the movable core 134 as shown in FIG. 7C, if the magnetic attraction force is generated at the attracting part 52*b* by the electricity supplied to the coil 50.

Similar to the first embodiment, when the second engagement part 64*b* of the movable core 134 is engaged with the second engagement part 62*b* of the needle valve 120, a force calculated by subtracting the elastic force from a momentum force of the movable core 134 and the magnetic attraction force applied to the movable core 134 is transmitted to the needle valve 120 through the engagement parts 62*b*, 64*b*. The needle valve 120 is moved in the separating direction in accordance with a force calculated by subtracting the force to thrust the needle valve 120 in the seating direction from the force transmitted from the movable core 134. Thereby, the contact part 30 is separated from the seat portion 18*b*.

If the contact part 30 is separated from the seat portion 18*b*, a clearance is generated between the contact part 30 and the seat portion 18*b*. Fuel is supplied to the injection hole 18*c* from the fuel passage 60 through the clearance, and fuel is injected from the injection hole 18*c*.

According to the second embodiment, while the needle valve 120 is moved in the separating direction, the magnetic attraction force and the momentum force of the movable core 134 are applied to the needle valve 120. Therefore, even if the position relationship of the engagement parts 62*a*, 62*b*, 64*a*, 64*b* is different from that of the first embodiment, the moving speed of the needle valve 120 can be raised in the separating direction. Thus, a ratio of fuel having relatively large particle diameter can be reduced when fuel is injected from the injection hole 18*c*, similar to the first embodiment.

If the engagement parts 62*b*, 64*b* are engaged with each other, the engagement parts 62*a*, 64*a* are not engaged with each other. In this case, similar to the first embodiment, the movement of the needle valve 120 may not correspond to the movement of the movable core 134 after the engagement parts 62*b*, 64*b* are engaged with each other. At this time, fuel injection may not be accurately performed.

According to the second embodiment, the needle valve 120 has the pressure receiving face 126. The engagement between the second engagement part 62*b* of the needle valve 120 and the second engagement part 64*b* of the movable core 134 can be maintained because fuel pressure is applied to the receiving face 126 from the fuel passage 60, even if the contact part 30 is distant from the seat portion 18*b*. Thus, fuel injection can be accurately performed, because the separating movement of the needle valve 120 can be made to follow the movement of the movable core 134.

When the second engagement parts 62*b*, 64*b* are engaged with each other, and when the movable core 134 is moved by the distance L3-(L2-L1) as shown in FIG. 7C, the outer wall face 138*a* of the movable core 134 will collide with the attracting part 52*b*. If the movable core 134 collides with the attracting part 52*b*, the movable core 134 will rebound in the seating direction. Because relative motion is possible between the movable core 134 and the needle valve 120, the needle valve 120 can continue moving in the separating direction due to inertia force. Thus, the needle valve 120 becomes less affected by the rebound of the movable core 134 at the fixed core 52. Accordingly, a variation of injection rate can be reduced when the needle valve 120 has the maximum lift.

Figure 8C:
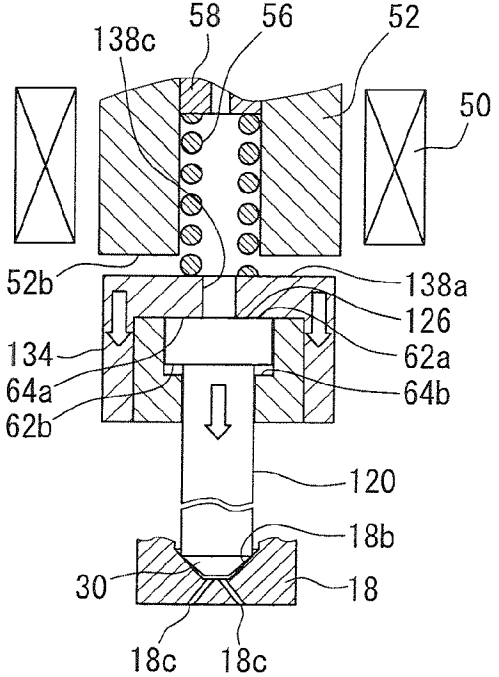
FIGS. 8A, 8B and 8C are views illustrating a movement of the movable core and a movement of the needle valve of the second embodiment when fuel injection is stopped.
Figure 8B:
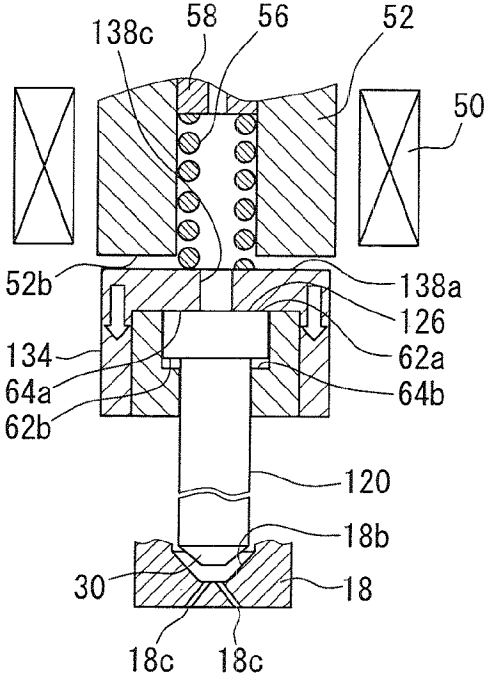
Figure 8A:
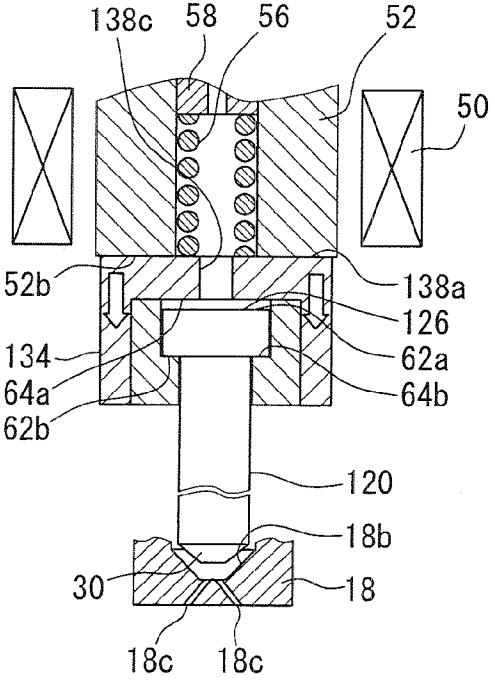

As shown in FIG. 8A, if electricity supply to the coil 50 is stopped in the state where the movable core 134 is contact with the fixed core 52, the magnetic attraction force generated in the attracting part 52*b* of the fixed core 52 will be extinguished. Thereby, the movable core 134 is moved in the seating direction by the elastic force of the coil spring 56. When the magnetic attraction force is extinguished, the first engagement part 62*a* of the needle valve 120 and the first engagement part 64*a* of the movable core 134 are separated from each other, so that only the movable core 134 is moved in the seating direction, because the needle valve 120 tries to remain at that occasion due to inertia force. The needle valve 120 may also be moved in the seating direction together with the movable core 134 due to the thrust force in the seating direction based on the difference between the fuel pressure applied to the face 126 and the fuel pressure applied to the contact part 30. A case where only the movable core 134 is moved will be described in the present embodiment.

As shown in FIG. 8B, if the movable core 134 is moved in the seating direction, the engagement between the second engagement part 62*b* of the needle valve 120 and the second engagement part 64*b* of the movable core 134 will be canceled. Then, if the movable core 134 is further moved in the seating direction, the first engagement part 64*a* of the movable core 134 will be engaged with the first engagement part 62*a* of the needle valve 120. At this time, the contact part 30 of the needle valve 120 is separated from the seat portion 18*b*.

Because the first engagement part 62*a* and the first engagement part 64*a* are engaged with each other, the movable core 134 is restricted from moving in the seating direction relative to the needle valve 120. Therefore, the elastic force of the coil spring 56 applied to the movable core 134 is transmitted to the needle valve 120 through the first engagement part 62*a* and the first engagement part 64*a*. Thereby, the needle valve 120 is moved in the seating direction together with the movable core 134.

As shown in FIG. 8C, the contact part 30 of the needle valve 120 is seated on the seat portion 18*b* again, and the clearance between the contact part 30 and the seat portion 18*b* is eliminated. Thereby, fuel injection from the injection hole 18*c* stops because fuel supply from the fuel passage 60 to the injection hole 18*c* stops. The coil spring 56 always presses the movable core 134 in the seating direction. Therefore, the elastic force is transmitted to the needle valve 120 through the first engagement part 62*a* and the first engagement part 64*a* also after the needle valve 120 is seated on the seat portion 18*b*. Thereby, the seating state of the needle valve 120 is maintained. Moreover, simultaneously, due to the coil spring 56, the movable core 134 can be held in the position in a manner that the first engagement part 62*a* and the first engagement part 64*a* are engaged with each other, and that the second engagement part 62*b* and the second engagement part 64*b* are separated from each other.

According to the second embodiment, similar to the first embodiment, the needle valve 120 can be maintained to be seated on the seat portion 18*b* only by the single coil spring 56. Further, the movable core 134 can be maintained to be located at a predetermined position in a manner that the engagement parts 62*b*, 64*b* are separated from each other. That is, a stopper or an elastic member to press the movable core 134 onto the stopper is unnecessary for holding the movable core 134 at the predetermined position, compared with the conventional fuel injection valve. Due to the coil spring 56 of the present embodiment, the needle valve 120 is maintained to be seated on the seat portion 18*b*, and the movable core 134 is maintained to be located at the predetermined position. Accordingly, the moving speed of the needle valve 120 can be made higher in the separating direction with the simple structure.

Third Embodiment

A third embodiment will be described with reference to FIG. 9, and corresponds to a modification of the second embodiment.

A needle valve 220 and a movable core 234 of a fuel injection valve 210 will be described with reference to FIG. 9.

Similar to the second embodiment, the needle valve 220 has a shaft 222 and a contact part 30. The contact part 30 has a conical shape, and a diameter of the contact part 30 is made smaller as extending toward the seat portion 18*b*.

The shaft 222 has an annular projection 224 projected outward from a side face 222*a* of the shaft 222 in a radial direction. The projection 224 is located at a predetermined position in the axis direction. The projection 224 has an end face 224*a* and an end face 224*b* opposite from each other. The end face 224*a*, 224*b* has a taper shape in a manner that a dimension between the end faces 224*a*, 224*b* becomes smaller as approaching a recess 250 of the movable core 234. That is, the end faces 224*a*, 224*b* are inclined relative to a plane perpendicular to the axis direction of the needle valve 220. Further, an end face 224*c* of the projection 224 in the radial direction is defined between the end faces 224*a*, 224*b*, and is not contact with the recess 250.

The projection 224 of the needle valve 220 defines a stopper portion 62 having a first engagement part 62*a* and a second engagement part 62*b*. The first engagement part 62*a* is defined by the end face 224*a* of the projection 224 located opposite from the seat portion 18*b*. The second engagement part 62*b* is defined by the end face 224*b* of the projection 224 adjacent to the seat portion 18*b*. The first engagement part 62*a* and the second engagement part 62*b* are arranged along the axis direction of the needle valve 220.

The shaft 222 has a pressure receiving face 226 located on an end opposite from the contact part 30 in the separating direction. The face 226 has shape and area in a manner that the needle valve 220 is thrust in the seating direction by a difference between fuel pressure applied to the face 226 and fuel pressure applied to the contact part 30 when the contact part 30 is seated on or separated from the seat portion 18*b*.

Figure 10:
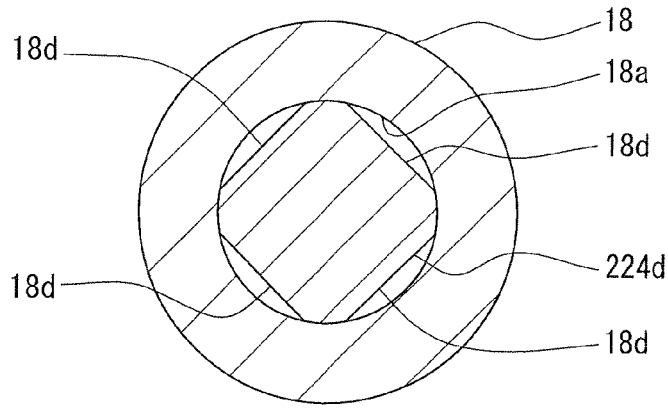
FIG. 10 is a cross-sectional view taken along line X-X of FIG. 9.

The shaft 222 has a support part 224*d* to be supported by an inner wall face 18*a* of a nozzle body 18. The support part 224*d* is located adjacent to the contact part 30, and is distanced from the projection 224. The inner wall face 18*a* supports the support part 224*d* in a manner that movement of the support part 224*d* is allowed in the axis direction and is prohibited in a direction intersecting the axis direction, i.e., the radial direction. As shown in FIG. 10, a cross-section of the support part 224*d* is not circle but approximately rectangular. Corners of the rectangular shape are supported by the inner wall face 18*a*. A fuel passage 18*d* is defined between the other parts of the rectangular shape and the inner wall face 18*a*, and fuel flows toward the injection hole 18*c* through the fuel passage 18*d*.

The movable core 234 has a cylindrical first member 236 and a based cylindrical second member 240. The inner wall face 12*d* of the tube member 12 supports a side face 238*b* of the first member 236 from outside in the radial direction, thereby the movement of the movable core 234 is restricted in the radial direction. Further, the movable core 234 is allowed to slidably move in the axis direction.

The first member 236 has an end face 238*h*, and a recess 238*d* recessed from the end face 238*h* in the separating direction. As shown in FIG. 9, an end portion of the shaft 222 opposite from the contact part 30 is located in the recess 238*d*. Further, the first member 236 has a communication path 238*c* to connect a bottom of the recess 238*d* to an end face 238*a* of the first member 236 opposing to the fixed core 52. An inner wall face 238*e* of the recess 238*d* supports the side face 222*a* of the shaft 222 from outside in the radial direction, and the supported part is located adjacent to the projection 224. Thus, the shaft 222 is allowed to slidably move in the axis direction, and is prohibited to move in the radial direction.

Figure 11:
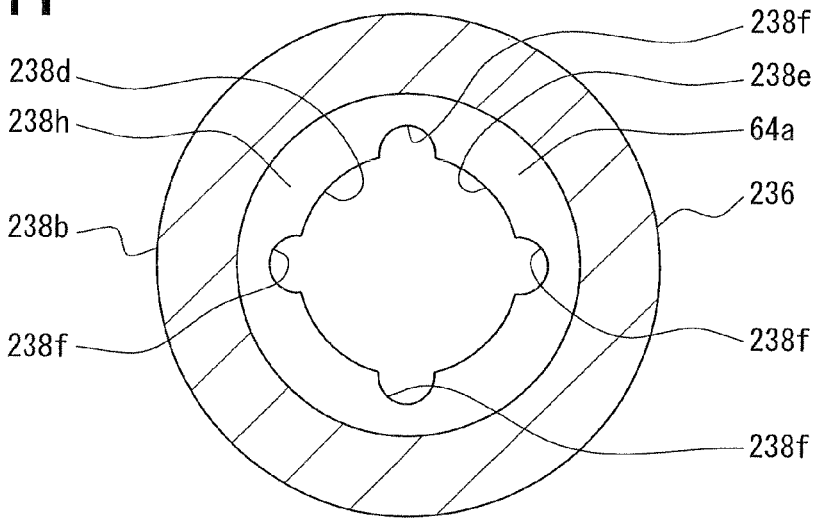
FIG. 11 is a cross-sectional view taken along line XI-XI of FIG. 9.

The first member 236 has a cylindrical cover part 238*g* extending from the end face 238*h* around an opening of the recess 238*d* in the seating direction. The cover part 238*g* surrounds the end face 238*h* and the second member 240. The inner wall face 238*e* of the recess 238*d* has a recessed communication path 238*f*. Due to the path 238*f*, a fuel space 250*a* located adjacent to end face 238*h* communicates with the communication path 238*c*. In this embodiment, as shown in FIG. 11, the communication path 238*f* has four parts in the circumference direction. FIG. 11 shows only a cross-section of the first member 236.

The second member 240 has a based cylinder shape, and is located inside of the cover part 238*g*. A bottom 242 of the second member 240 is located on the seating direction. A cylindrical side part 246 extends from the bottom 242 in the axis direction, and has an end face 246*a*. The end face 246*a* contacts the end face 238*h* surrounded by the cover part 238*g* of the first member 236. The second member 240 has a space 246*b* at corner of the side part 246. The space 246*b* is recessed in a direction opposite from an anchor of the cover part 238*g*.

An inner diameter of the side part 246 of the second member 240 is larger than an inner diameter of the recess 238*d* of the first member 236. Therefore, an inner wall face 242*a* of the bottom 242 of the second member 240 opposes to the end face 238*h* of the first member 236.

Figure 12:
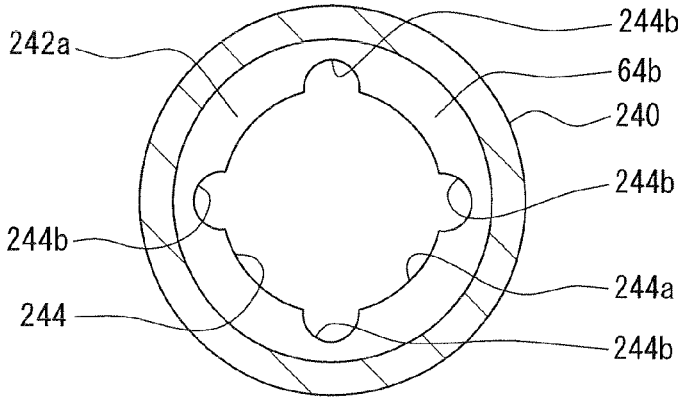
FIG. 12 is a cross-sectional view taken along line XII-XII of FIG. 9.

Further, the bottom 242 has a through hole 244, and the shaft 222 of the needle valve 220 adjacent to the projection 224 passes through the through hole 244. Further, an inner wall face 244*a* of the through hole 244 has a recessed communication path 244*b*. Due to the path 244*b*, the fuel space 250*a* and the fuel passage 60 located outside of the movable core 234 communicate with each other. The fuel space 250*a* is located between the inner wall face 242*a* of the bottom 242 of the second member 240 and the end face 238*h* of the first member 236. In this embodiment, as shown in FIG. 12, the communication path 244*b* has four parts in the circumference direction. FIG. 12 shows only a cross-section of the second member 240.

An axial length of the second member 240 is approximately equal to that of the cover part 238*g*. The cover part 238*g* has a length at least in a manner that an end of the cover part 238*g* is located adjacent to the seat portion 18*b* than the inner wall face 242*a* of the bottom 242 when the second member 240 is located in the cover part 238*g*. The first member 236 and the second member 240 are welded with each other through a welded part 252. As shown in FIG. 9, the welded part 252 is located adjacent to the seat portion 18*b* than the inner wall face 242*a* of the bottom 242 of the second member 240.

Figure 9:
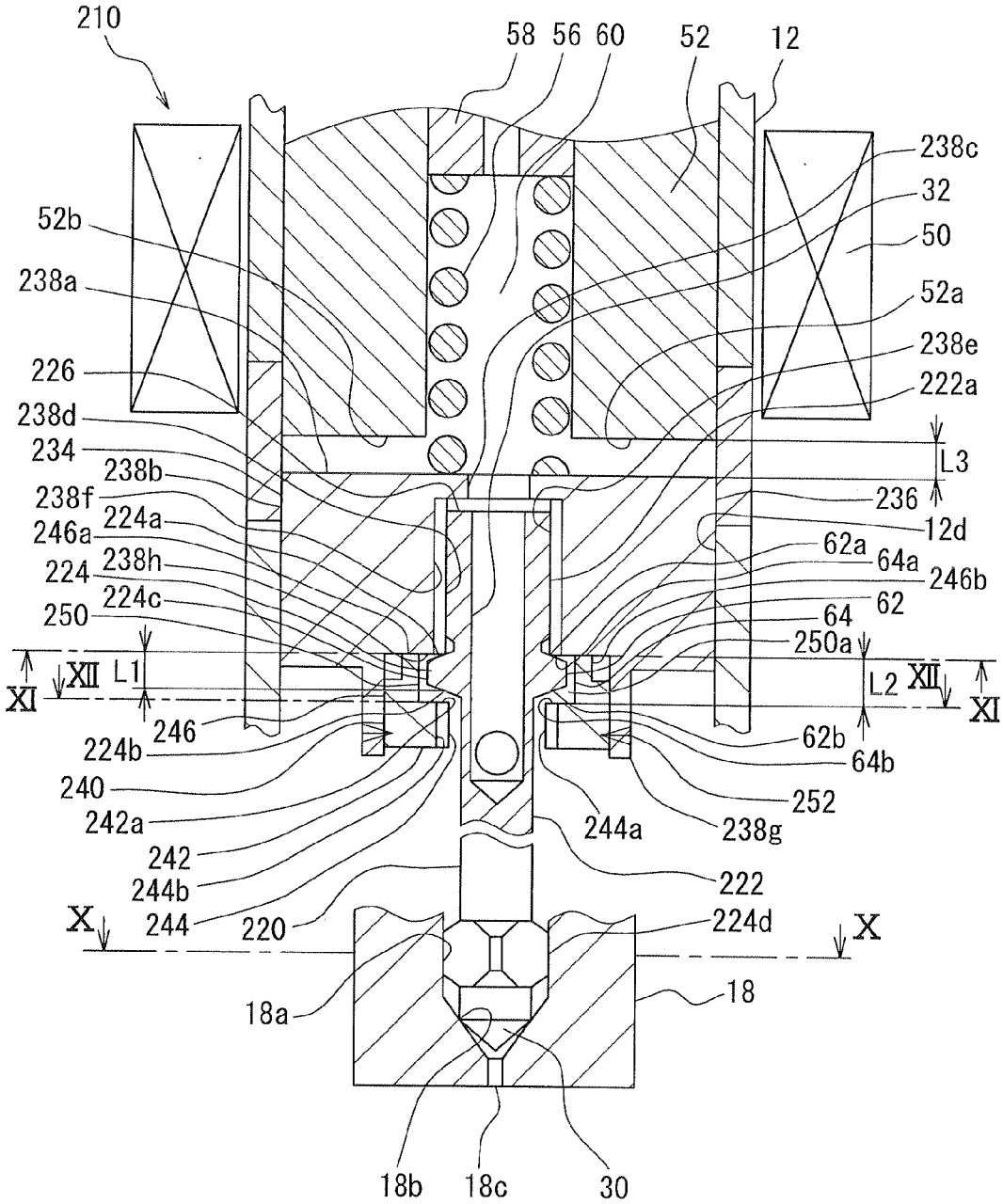
FIG. 9 is a schematic enlarged cross-sectional view of a fuel injection valve according to a third embodiment.

The recess 250 of the movable core 234 is defined by the first member 236 and the second member 240, as shown in FIG. 9. Inner faces of the recess 250 opposing to each other in the axis direction are defined by the end face 238*h* of the first member 236 and the inner wall face 242*a* of the bottom 242 of the second member 240. The faces 238*h*, 242*a* are approximately perpendicular to the axis direction. The recess 250 corresponds to a stopper portion 64 of the movable core 234. The end face 238*h* located opposite from the seat portion 18*b* is a first engagement part 64*a* of the stopper portion 64. The inner wall face 242*a* located adjacent to the seat portion 18*b* is a second engagement part 64*b* of the stopper portion 64.

In the third embodiment, similar to the second embodiment, the distance L1 defined between the first engagement part 62*a* and the second engagement part 62*b* of the stopper portion 62 of the needle valve 220 is smaller than the distance L2 defined between the first engagement part 64*a* and the second engagement part 64*b* of the stopper portion 64 of the movable core 234. Therefore, the movable core 234 can be moved relative to the needle valve 220 in the axis direction by a distance L2–L1, which is calculated by subtracting the distance L1 from the distance L2.

According to the third embodiment, similar to the second embodiment, the distance between the second engagement parts 62*b*, 64*b* is smaller than the distance L3 defined between the end face 238*a* of the movable core 234 and the attracting part 52*b*, when the first engagement part 62*a* of the needle valve 220 and the first engagement part 64*a* of the movable core 234 are engaged with each other, and when the contact part 30 of the needle valve 220 is seated on the seat portion 18*b*. Therefore, the needle valve 220 can move toward the fixed core 52 together with the movable core 234.

The distances L1, L2, L3 of the fuel injection valve 210 of the present embodiment are similar to those of the second embodiment. Therefore, the needle valve 220 and the movable core 234 have the same operations as the needle valve 120 and the movable core 134 of the second embodiment, so that description of the operations will be omitted.

The end face 224*a* of the projection 224 has an angle relative to the axis direction, and the angle is different from that of the end face 238*h* of the recess 250. The end face 224*b* of the projection 224 has an angle relative to the axis direction, and the angle is different from that of the inner wall face 242*a*. Advantages of these features are described below.

Figure 6:
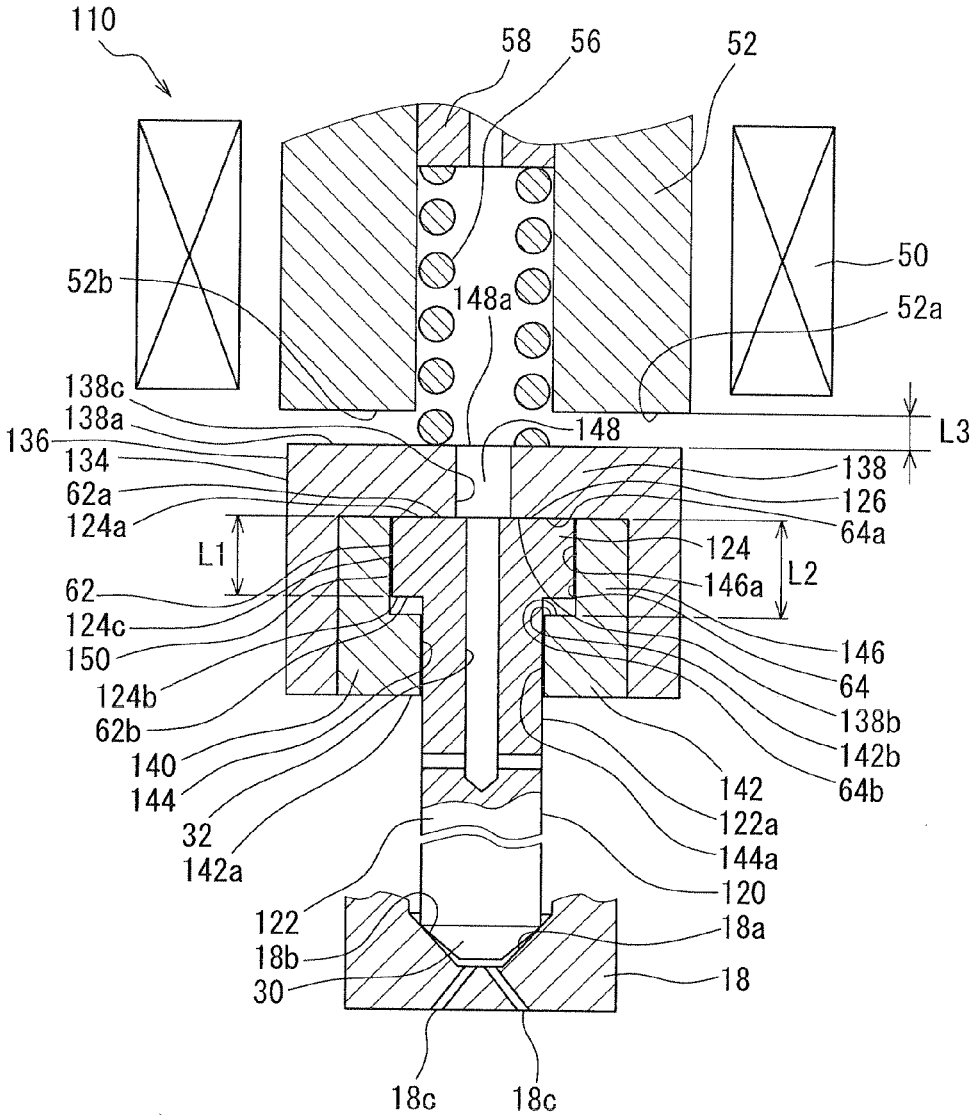
FIG. 6 is a schematic enlarged cross-sectional view of a fuel injection valve according to a second embodiment.

In the second embodiment of FIG. 6, the end face 124*a*, 124*b* of the projection 124 of the needle valve 120 corresponding to the engagement part 62*a*, 62*b* is approximately parallel to a plane perpendicular to the axis direction. Further, the inner wall face 138*b*, 142*b* of the recess 150 of the movable core 134 corresponding to the engagement part 64*a*, 64*b* is approximately parallel to a plane perpendicular to the axis direction.

Therefore, the engagement parts 62*a*, 64*a* have a face contact when the engagement parts 62*a*, 64*a* are engaged with each other, and the engagement parts 62*b*, 64*b* have a face contact when the engagement parts 62*b*, 64*b* are engaged with each other.

In this case, if fuel filled in the recess 150 flows into a minute clearance between the engagement parts 62*a*, 64*a*, the engagement parts 62*a*, 64*a* are adsorbed with each other by surface tension of fuel. As the contact area is set larger, the adsorption force becomes larger, because an amount of fuel flowing between the engagement parts 62*a*, 64*a* is increased.

For example, if the movable core 134 starts to move in the separating direction while the first engagement parts 62*a*, 64*a* are engaged with each other, the movement of the movable core 134 is restricted by the adsorption. In this case, responsivity of the movable core 134 may be lowered. Further, if the movable core 134 starts to move in the seating direction while the second engagement parts 62*b*, 64*b* are engaged with each other, the movement of the movable core 134 is restricted by the adsorption. In this case, responsivity of the movable core 134 may be lowered. Furthermore, responsivity of the needle valve 120 may be also lowered. The lowering of responsivity is larger as the adsorption force is larger.

In contrast, according to the third embodiment, the end face 224*a* of the projection 224 of the needle valve 220 is inclined relative to the plane perpendicular to the axis direction, and the end face 238*h* of the first member 236 of the movable core 234 is approximately parallel with the plane. Therefore, the angle relative to the axis direction is different between the end face 224*a* and the end face 238*h*. Thus, when the first engagement parts 62*a*, 64*a* are engaged with each other, the engagement parts 62*a*, 64*a* have a linear contact.

Further, the end face 224*b* of the projection 224 of the needle valve 220 is inclined relative to the plane perpendicular to the axis direction, and the inner wall face 242*a* of the bottom 242 of the second member 240 is approximately parallel with the plane. Therefore, the angle relative to the axis direction is different between the end face 224*b* and the inner wall face 242*a*. Thus, when the second engagement parts 62*b*, 64*b* are engaged with each other, the engagement parts 62*b*, 64*b* have a linear contact.

Due to the linear contact, the amount of fuel flowing between the engagement parts 62*a*, 64*a* and the amount of fuel flowing between the engagement parts 62*b*, 64*b* can be reduced compared with a case of the face contact. Therefore, the adsorption force generated between the engagement parts 62*a*, 64*a* and the adsorption force generated between the engagement parts 62*b*, 64*b* can be reduced. Thus, responsivity of the movable core 234 can be maintained high, and responsivity of the needle valve 220 can be maintained high in the third embodiment, compared with the case of the face contact.

Alternatively, the face 238*h*, 242*a* may be tapered while the face 224*a*, 224*b* is set parallel to the plane perpendicular to the axis direction. In this case, a dimension between the faces 238*h*, 242*a* may be increased as approaching the projection 224, and the same advantages can be obtained.

Advantages of the communication path 238*f*, 244*b* of the movable core 234 will be described below.

Fuel pressure in the fuel space 250*a* of the recess 250 defined between the end face 238*h* and the inner wall face 242*a* will be described. Because the movable core 234 is located in the tube member 12 through which fuel passes, the fuel space 250*a* is filled with fuel.

For example, in the second embodiment, if the projection 224 is moved in the fuel space 250*a* by the movement of the movable core 134, fuel in the fuel space 250*a* is disturbed by the projection 224, so that the pressure of the fuel space 250*a* becomes unstable. In this case, movements of the movable core 134 and the needle valve 120 may become stable.

In contrast, according to the third embodiment, the movable core 234 has the communication path 238*c*, 238*f*, 244*b*. The fuel space 250*a* communicates with the fuel passage 60 outside of the movable core 234 by the communication path 238*c*, 238*f*. Further, the fuel space 250*a* communicates with the fuel passage 60 outside of the movable core 234 by the communication path 244*b*. Therefore, fuel of the fuel space 250*a* can be easily discharged out of the movable core 234, or fuel can easily flow into the fuel space 250*a* from outside of the movable core 234.

For example, if the movable core 234 starts to move in the seating direction while the second engagement parts 62*b*, 64*b* are engaged with each other, fuel in the fuel space 250*a* is disturbed by the projection 224. At this time, fuel space between the end face 238*h* and the end face 224*a* is gradually made smaller, and fuel space between the inner wall face 242*a* and the end face 224*b* is gradually made larger. When a volume variation is generated in the fuel space 250*a*, fuel around the end face 224*a* flows into the fuel passage 60 through the path 238*f*, 238*c*, and fuel flows from the fuel passage 60 toward the end face 224*b* through the path 244*b*. Therefore, the pressure of the fuel space 250*a* can be stable even if the projection 224 is moved. Thus, due to the path 238*c*, 238*f*, 244*b*, the pressure of the fuel space 250*a* can be stable if the movable core 234 is moved. Therefore, the movements of the movable core 234 and the needle valve 220 can be made stable. The movable core 234 is not limited to have all of the paths 238*c*, 238*f*, 244*b*. The needle valve 220 can have stable movement if the movable core 234 has only one of the paths 238*c*, 238*f*, 244*b*.

According to the third embodiment, the path 238*f*, 244*b* is open to the recess 250 at a predetermined position in a manner that the contact area between the engagement parts 62*a*, 64*a* and the contact area between the engagement parts 62*b*, 64*b* can be further reduced.

An end of the path 238*f* adjacent to the recess 250 is open in the first engagement part 64*a* to contact with the first engagement part 62*a*. In this case, as shown in FIG. 11, the contact area between the engagement parts 62*a*, 64*a* is reduced compared with a case where the path 238*f* is open at the other positions. Therefore, the adsorption force can be further reduced, so that responsivity of the movable core 234 in the separating direction can be further improved.

An end of the path 244*b* adjacent to the recess 250 is open in the second engagement part 64*b* to contact with the second engagement part 62*b*. In this case, as shown in FIG. 12, the contact area between the engagement parts 62*b*, 64*b* is reduced compared with a case where the path 244*b* is open at the other positions. Therefore, the adsorption force can be further reduced, so that responsivity of the movable core 234 in the seating direction can be further improved.

Further, when the path 238*f*, 244*b* has the above opening position, the path 238*f* is located adjacent to the engagement between the engagement parts 62*a*, 64*a*, and the path 244*b* is located adjacent to the engagement parts 62*b*, 64*b*. Therefore, when the engagement parts 62*a*, 64*a* are separated from each other, or when the engagement parts 62*b*, 64*b* are separated from each other, fuel can quickly flow into the path 238*f*, 244*b*, and the surface tension of fuel can be quickly reduced. Thus, the adsorption force can be quickly reduced. Accordingly, responsivity of the movable core 234 can be improved in the seating direction and the separating direction.

As shown in FIG. 9, the side face 238*b* of the first member 236 is supported by the inner wall face 12*d* of the tube member 12 in a manner that the movable core 234 is prohibited from moving in the radial direction and is allowed to move in the axis direction. Therefore, the inner wall face 238*e* of the recess 238*d* of the first member 236 is moved along the axis direction without movement in the radial direction. Further, the inner wall face 238*e* supports the side face 222*a* of the shaft 222 adjacent to the projection 224 from outside in the radial direction, so that movement in the radial direction is prohibited and that sliding movement in the axis direction is allowed.

The inner wall face 18*a* of the nozzle body 18 supports the support part 224*d* from outside in the radial direction, so that the support part 224*d* is prohibited from moving in the radial direction and is allowed to slidably move in the axis direction.

The needle valve 220 is supported by the plural positions along the axis direction. Therefore, the needle valve 220 can move in the axis direction without inclination. Thus, open/close operation of the needle valve 220 can be stable.

While two members are welded with each other, the two members may have distortion by heat of the welding. For example, a movable core is constructed by two members, and engagement parts are defined on end portions of the two members opposing to each other. If welding is performed at the end portions, distortion may be easily generated because a distance between the welding position and the engagement part is short. If distortion is generated, a predetermined injection performance may not be obtained.

In contrast, according to the present embodiment, the movable core 234 has the two members 236, 240, and the engagement parts 64*a*, 64*b* are defined on end portions of the members 236, 240 opposing to each other. The first member 236 has the cover part 238*g* extending in the seating direction so as to surround the first engagement part 64*a* and the second member 240. The welded part 252 between the members 236, 240 is located on the cover part 238*g* adjacent to the seat portion 18*b* than the second engagement part 64*b* of the second member 240.

Therefore, the welded part 252 is located far from the engagement part 64*a*, so that the engagement part 64*a* is restricted from having distortion by heat of welding. Further, because the cover part 238*g* is configured to surround the second member 240, the cover part 238*g* can extend free from the second member 240. A thickness of the bottom 242 of the second member 240 is made larger in accordance with the cover part 238*g*. A part of the cover part 238*g* distant from the engagement part 64*b* in the seating direction is welded. Therefore, the welded part 252 can be made far from the engagement part 64*b*, so that the engagement part 64*b* is restricted from having distortion by heat of welding. That is, the first member 236 has the cover part 238*g* extending in the seating direction further from the engagement part 64*a*, and the welded part 252 is located adjacent to the seat portion 18*b* than the engagement part 64*b*. In this case, the engagement part 64*a*, 64*b* is restricted from having distortion by heat of welding, so that the predetermined injection performance can be obtained.

The end face 246*a* of the cylindrical side part 246 extending in the axis direction from the bottom 242 of the second member 240 is contact with the end face 238*h* of the first member 236 surrounded by the cover part 238*g*, thereby the second member 240 is accommodated in the cover part 238*g*. Therefore, a distance between the inner wall face 242*a* and the end face 238*h* is dependent from a length of the side part 246. A distance between the engagement parts 64*a*, 64*b* is controlled by cutting the end face 246*a* of the side part 246. Thus, the distance between the engagement parts 62*a*, 64*a* and the distance between the engagement parts 62*b*, 64*b* are controlled. Accordingly, the distance can be restricted from having variation, and the injection performance can be made uniform.

However, if the distance between the engagement parts 64*a*, 64*b* is set by making the end face 246*a* to contact the end face 238*h*, the side part 246 may overlap with a round (R) portion of the anchor of the cover part 238*g*. In this case, the end face 246*a* of the side part 246 cannot accurately contact with the end face 238*h* of the cover part 238*g*. Even if the end face 246*a* is cut, the distance between the engagement parts 64*a*, 64*b* may not be controlled properly.

In contrast, according to the present embodiment, the corner of the side part 246 opposing to the anchor of the cover part 238*g* has the recessed space 246*b* recessed in the direction opposite from the anchor of the cover part 238*g*. Therefore, the side part 246 can be restricted from overlapping with the R portion when the end face 246*a* is made contact with the end face 238*h*. Thus, the end face 246*a* of the side part 246 can be accurately contact with the end face 238*h*. Accordingly, the distance between the engagement parts 64*a*, 64*b* of the movable core 234 can be accurately controlled.

The inner wall face 238*e* of the recess 238*d* corresponds to a first guide portion. The inner wall face 18*a* of the nozzle body 18 corresponds to a second guide portion. The side part 246 of the second member 240 corresponds to an extension portion. The communication path 238*c*, 238*f* corresponds to a through hole. The communication path 244*b* corresponds to a through hole.

Figure 13:
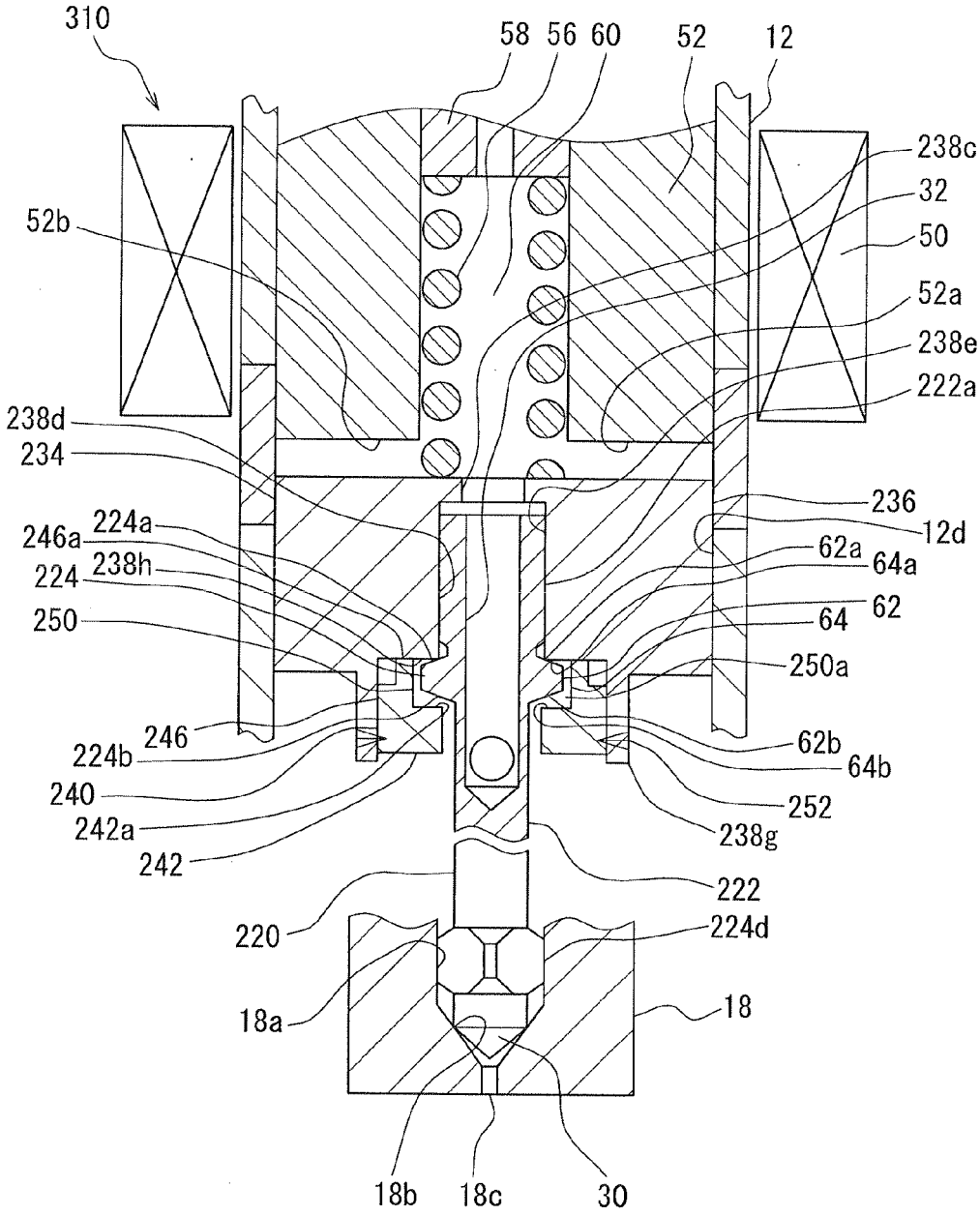
FIG. 13 is a schematic enlarged cross-sectional view of a modified fuel injection valve of the third embodiment.

A modification of the third embodiment will be described with reference to FIG. 13. As shown in FIG. 13, a fuel injection valve 310 does not include the communication path 238*f*, 244*b* of the fuel injection valve 210 of the third embodiment.

The end face 224*a* of the projection 224 is inclined relative to the plane perpendicular to the axis direction, and the end face 238*h* of the first member 236 is approximately parallel with the plane. The end face 224*b* of the projection 224 is inclined relative to the plane perpendicular to the axis direction, and the inner wall face 242*a* of the second member 240 is approximately parallel with the plane. Therefore, similar to the third embodiment, the engagement parts 62*a*, 64*a* have a linear contact, and the engagement parts 62*b*, 64*b* have a linear contact. Due to the linear contact, the amount of fuel flowing between the engagement parts 62*a*, 62*b*, and the amount of fuel flowing between the engagement parts 64*a*, 64*b* can be reduced. Therefore, the adsorption force generated between the engagement parts 62*a*, 62*b*, and the adsorption force generated between the engagement parts 64*a*, 64*b* can be reduced. Thus, responsivity of the needle valve 220 can be maintained high.

Fourth Embodiment

Figure 14:
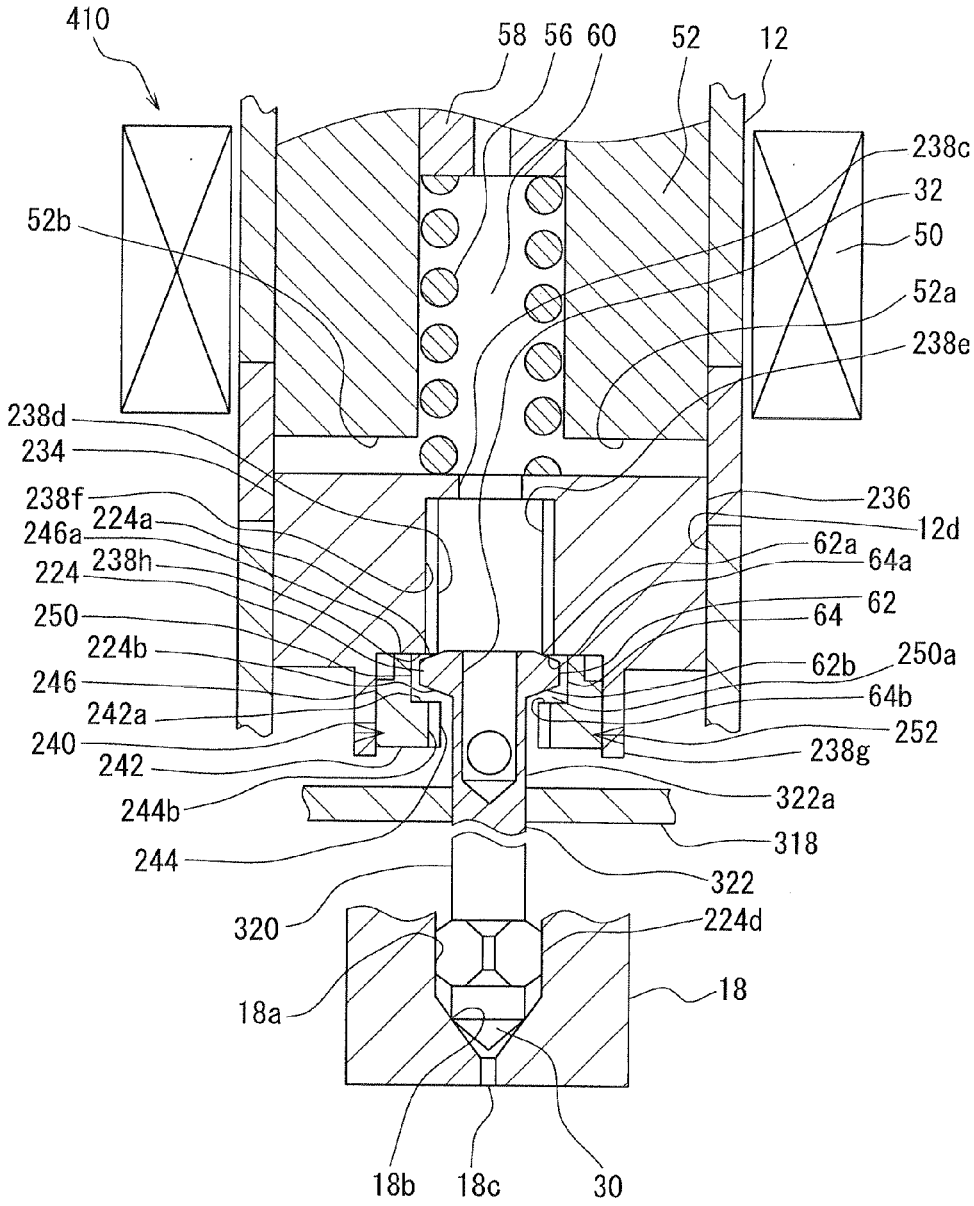
FIG. 14 is a schematic enlarged cross-sectional view of a fuel injection valve according to a fourth embodiment.

A fuel injection valve 410 of a fourth embodiment will be described with reference to FIG. 14. The projection 224 of the third embodiment is located at the middle position in the needle valve 220 of the fuel injection valve 210, 310. In contrast, a projection 224 of the fourth embodiment is located on an end portion of a shaft 322 of a needle valve 320 of the fuel injection valve 410 on the separating direction. The shaft 322 is not located in the recess 238*d* of the first member 236. Other components other than the needle valve 320 are similar to those of the third embodiment.

The needle valve 320 is supported at only one position in the axis direction. Specifically, only the support part 224*d* of the needle valve 320 is supported by the nozzle body 18. In this case, the needle valve 320 may be inclined from the axis direction.

In contrast, according to the fourth embodiment, a guide portion 318 is arranged on an inner circumference side of the tube member 12 or the holder 16 as a part of the body. The guide portion 318 supports the side face 322*a* of the shaft 322 between the support part 224*d* and the projection 224 from outside in the radial direction. Therefore, the portion between the support part 224*d* and the projection 224 is prohibited from moving in the radial direction, and is allowed to slidably move in the axis direction. Therefore, the side face 322*a* supported by the guide portion 318 is moved in the axis direction without movement in the radial direction. The portion supported by the guide portion 318 is located adjacent to the seat portion 18*b* than the inner wall face 238*e*. The guide portion 318 corresponds to a first guide portion.

Because the needle valve 320 is supported by the two positions in the axis direction, the needle valve 320 can be moved in the axis direction without inclination. Therefore, open/close operation of the needle valve 320 can be stable.

Figure 15:
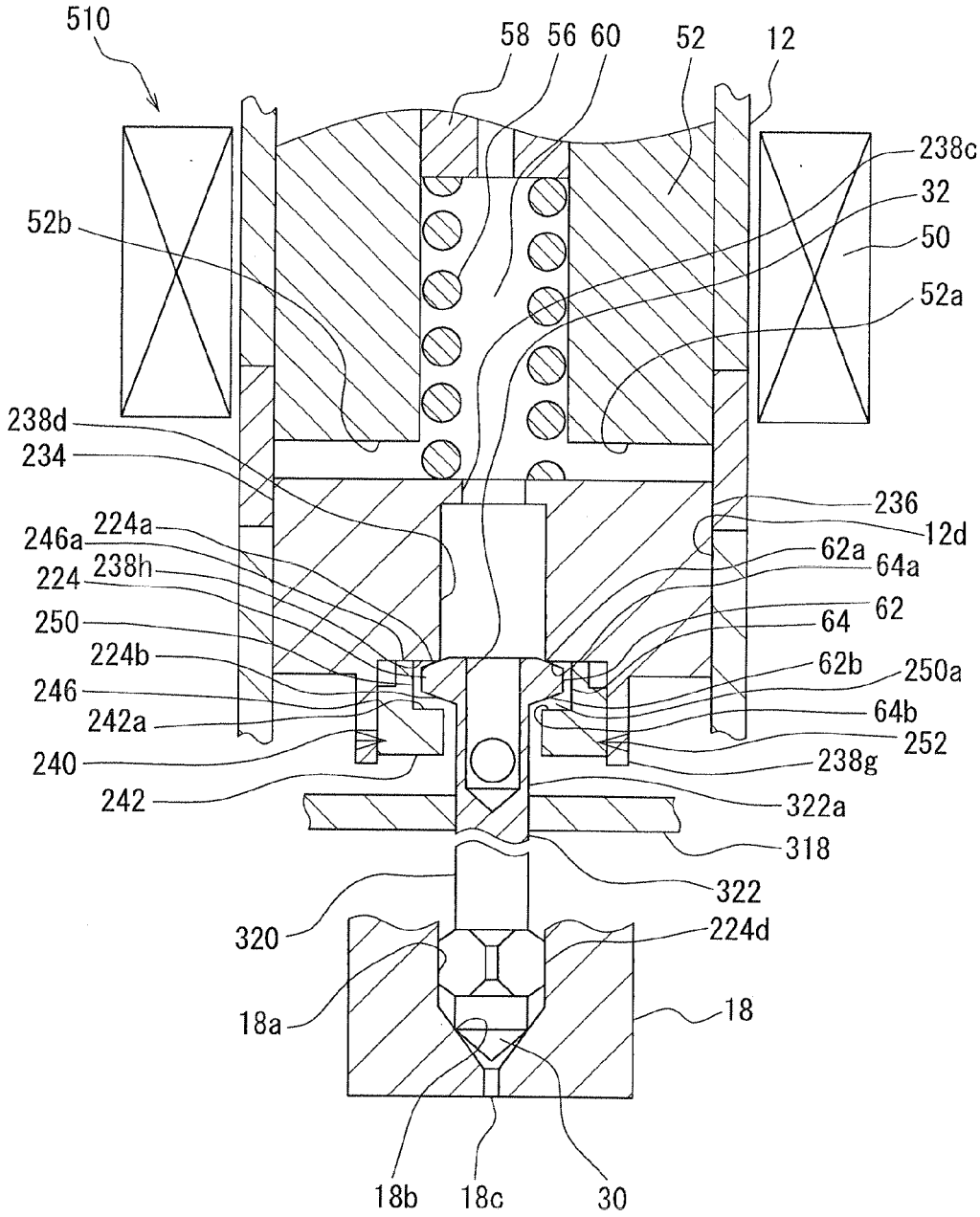
FIG. 15 is a schematic enlarged cross-sectional view of a modified fuel injection valve of the fourth embodiment.

A modification of the fourth embodiment will be described with reference to FIG. 15. As shown in FIG. 15, a fuel injection valve 510 does not include the communication path 238*f*, 244*b* of the fuel injection valve 410 of the fourth embodiment.

The end face 224*a* of the projection 224 is inclined relative to the plane perpendicular to the axis direction, and the end face 238*h* of the first member 236 is approximately parallel with the plane. The end face 224*b* of the projection 224 is inclined relative to the plane perpendicular to the axis direction, and the inner wall face 242*a* of the second member 240 is approximately parallel with the plane. Therefore, similar to the third embodiment, the engagement parts 62*a*, 64*a* have a linear contact, and the engagement parts 62*b*, 64*b* have a linear contact. Due to the linear contact, the amount of fuel flowing into the engagement parts 62*a*, 64*a*, and the amount of fuel flowing into the engagement parts 62*b*, 64*b* can be reduced. Therefore, the adsorption force generated between the engagement parts 62*a*, 64*a*, and the adsorption force generated between the engagement parts 62*b*, 64*b* can be reduced. Thus, responsivity of the needle valve 320 can be maintained high.

The present invention is not limited to the above embodiments, and changes and modifications are to be understood as being within the scope of the present invention as defined by the appended claims.

The first member 136 and the second member 140 of the movable core 134 are fixed by welding in the second embodiment. Alternatively, the second member 140 may be fitted into the first member 136.

The fuel injection valve 10, 110, 210, 310, 410, 510 is not limited to be mounted in the direct injection type gasoline engine. Alternatively, the fuel injection valve 10, 110, 210, 310, 410, 510 may be mounted in a port injection type gasoline engine or diesel engine.

Such changes and modifications are to be understood as being within the scope of the present invention as defined by the appended claims.

What is claimed is:

1. A fuel injection valve comprising:

a body having an injection hole to inject fuel and a seat portion located upstream of the injection hole in a fuel flowing direction;

a needle valve to be linearly reciprocated in an axis direction of the body, fuel injection from the injection hole being prohibited when the needle valve is seated on the seat portion in a seating direction and being allowed when the needle valve is separated from the seat portion in a separating direction;

a cylindrical movable core to be moved relative to the needle valve, the needle valve being moved in the seating direction when the movable core is moved in the seating direction, the needle valve being moved in the separating direction when the movable core is moved in the separating direction;

an electromagnetic driving portion to generate magnetic attraction force to attract the movable core in the separating direction by being supplied with electricity; and a biasing portion to contact and bias the movable core in the seating direction, wherein the needle valve has a first engagement part and a second engagement part to be engaged with the movable core, the movable core has a first engagement part to be engaged with the first engagement part of the needle valve, and a second engagement part to be engaged with the second engagement part of the needle valve, one of a set of the first engagement part and the second engagement part of the needle valve and a set of the first engagement part and the second engagement part of the movable core is defined by two inner faces of a recess opposing to each other in the axis direction, and the other set is defined by two outer faces of a projection opposing to the inner faces, respectively, the projection being movable between the inner faces in the axis direction in a state that the projection is located in the recess, the movable core is restricted from being moved in the seating direction relative to the needle valve when the first engagement part of the needle valve and the first engagement part of the movable core are engaged with each other, the movable core is restricted from being moved in the separating direction relative to the needle valve when the second engagement part of the needle valve and the second engagement part of the movable core are engaged with each other;

a first distance defined between the first engagement part of the needle valve and the second engagement part of the needle valve is larger than a second distance defined between the first engagement part of the movable core and the second engagement part of the movable core, The electromagnetic driving portion has an attracting part to attract and contact the movable core when the electromagnetic driving portion is activated, a third distance being defined between the attracting part and a part of the movable core to contact with the attracting part, and the third distance is longer than the difference between the first distance and the second distance.

2. The fuel injection valve according to claim 1, wherein the needle valve has a pressure receiving face to which a pressure of fuel flowing into the body applies so as to generate a force to thrust the needle valve in the seating direction.

3. The fuel injection valve according to claim 2, wherein the movable core has an inner space to communicate with outside of the movable core, the pressure receiving face is located in the inner space, and the biasing portion has an outer diameter larger than an inner diameter of an opening of the inner space exposed from the movable core.

4. The fuel injection valve according to claim 1, wherein the third distance is longer than another distance defined between the second engagement part of the needle valve and the second engagement part of the movable core when the first engagement part of the needle valve and the first engagement part of the movable core are engaged with each other and when the needle valve is seated on the seat portion.

5. The fuel injection valve according to claim 1, wherein the needle valve has the recess, and the movable core has the projection, the first engagement part of the needle valve is defined by one of the inner faces of the recess adjacent to the seat portion, and the second engagement part of the needle valve is defined by the other inner face of the recess opposite from the seat portion, and the first engagement part of the movable core is defined by one of the outer faces of the projection adjacent to the seat portion, and the second engagement part of the movable core is defined by the other outer face of the projection opposite from the seat portion.

6. The fuel injection valve according to claim 1, wherein the movable core has the recess, and the valve needle has the projection, the first engagement part of the movable core is defined by one of the inner faces of the recess opposite from the seat portion, and the second engagement part of the movable core is defined by the other inner face of the recess adjacent to the seat portion, and the first engagement part of the needle valve is defined by one of the outer faces of the projection opposite from the seat portion, and the second engagement part of the needle valve is defined by the other outer face of the projection adjacent to the seat portion.

7. The fuel injection valve according to claim 6, wherein the inner face corresponding to the first engagement part of the movable core has an angle relative to the axis direction, and the angle is different from an angle of the outer face corresponding to the first engagement part of the needle valve relative to the axis direction, and the inner face corresponding to the second engagement part of the movable core has an angle relative to the axis direction, and the angle is different from an angle of the outer face corresponding to the second engagement part of the needle valve relative to the axis direction.

8. The fuel injection valve according to claim 7, wherein the inner faces of the recess are perpendicular to the axis direction, and the outer faces of the projection have taper shape in a manner that a dimension between the outer faces becomes smaller as approaching the recess.

9. The fuel injection valve according to claim 7, wherein the inner faces of the recess have taper shape in a manner that a dimension between the inner faces becomes larger as approaching the projection, and the outer faces of the projection are perpendicular to the axis direction.

10. The fuel injection valve according to claim 1, wherein the body has an inner wall face to support the movable core from outside in a radial direction, the inner wall face of the body restricting the movable core from moving in a direction intersecting the axis direction, the inner wall face of the body allowing the movable core to move in the axis direction by sliding a side face of the movable core, the movable core has a first guide portion to support the needle valve from outside in the radial direction, the first guide portion restricting the needle valve from moving in a direction intersecting the axis direction, the first guide portion allowing the needle valve to move in the axis direction by sliding a side face of the needle valve, and the body has a second guide portion to support a support part of the needle valve from outside in the radial direction, the support part being located adjacent to the seat portion than the first guide portion, the second guide portion restricting the needle valve from moving in a direction intersecting the axis direction, the second guide portion allowing the needle valve to move in the axis direction by sliding the support part.

11. The fuel injection valve according to claim 1, wherein the body has a first guide portion to support the needle valve from outside in a radial direction, the first guide portion restricting the needle valve from moving in a direction intersecting the axis direction, the first guide portion allowing the needle valve to move in the axis direction by sliding a side face of the needle valve, and the body has a second guide portion to support a support part of the needle valve from outside in the radial direction, the support part being located adjacent to the seat portion than the first guide portion, the second guide portion restricting the needle valve from moving in a direction intersecting the axis direction, the second guide portion allowing the needle valve to move in the axis direction by sliding the support part.

12. The fuel injection valve according to claim 6, wherein the body and a fuel space in the recess are filled with fuel, and the movable core has a through hole through which the fuel space in the recess communicates with outside of the movable core.

13. The fuel injection valve according to claim 12, wherein the through hole is open in an engagement section between the first engagement part of the movable core and the first engagement part of the needle valve when the first engagement part of the movable core and the first engagement part of the needle valve are engaged with each other.

14. The fuel injection valve according to claim 12, wherein the through hole is open in an engagement section between the second engagement part of the movable core and the second engagement part of the needle valve when the second engagement part of the movable core and the second engagement part of the needle valve are engaged with each other.

15. The fuel injection valve according to claim 6, wherein the movable core has a first member and a second member arranged in the axis direction, the first member and the second member being welded with each other through a welded part, the first member has an end face adjacent to the seat portion corresponding to the first engagement part of the movable core, and the second member has an end face opposite from the seat portion corresponding to the second engagement part of the movable core, the second member being located between the first member and the seat portion in the axis direction, the first member has a cover part extending in the seating direction so as to surround the first engagement part of the movable core and the second member, and the welded part is located in the cover part between the second engagement part of the movable core and the seat portion in the axis direction.

16. The fuel injection valve according to claim 6, wherein the movable core has a first member and a second member arranged in the axis direction, the first member and the second member being joined with each other, the first member has an end face adjacent to the seat portion corresponding to the first engagement part of the movable core, and the second member has an end face opposite from the seat portion corresponding to the second engagement part of the movable core, the second member being located between the first member and the seat portion in the axis direction, the second member has an extension portion extending from the second engagement part of the movable core toward the first member, the first member has a cover part extending in the seating direction so as to surround the first engagement part of the movable core and the second member, the extension portion of the second member has an end face contact with the first member surrounded by the cover part so as to determine a position of the second member relative to the first member, and the second member has a space recessed in a direction opposite from an anchor of the cover part, and the space is located at a corner of the extension portion opposing to the anchor of the cover part.

* * * * *